US009624756B2

(12) United States Patent
Cast et al.

(10) Patent No.: US 9,624,756 B2
(45) Date of Patent: Apr. 18, 2017

(54) SLIDING SLEEVE HAVING CONTRACTING, DUAL SEGMENTED BALL SEAT

(71) Applicant: Weatherford/Lamb, Inc., Houston, TX (US)

(72) Inventors: Michael W. Cast, Houston, TX (US); James F. Wilkin, Sherwood Park (CA)

(73) Assignee: Weatherford Technology Holdings, LLC, Houston, TX (US)

( * ) Notice: Subject to any disclaimer, the term of this patent is extended or adjusted under 35 U.S.C. 154(b) by 441 days.

(21) Appl. No.: 14/104,305

(22) Filed: Dec. 12, 2013

(65) Prior Publication Data

US 2014/0166112 A1 Jun. 19, 2014

Related U.S. Application Data

(60) Provisional application No. 61/736,993, filed on Dec. 13, 2012.

(51) Int. Cl.
*E21B 34/14* (2006.01)
*E21B 43/12* (2006.01)
(Continued)

(52) U.S. Cl.
CPC ..... *E21B 34/14* (2013.01); *E21B 43/12* (2013.01); *E21B 43/26* (2013.01);
(Continued)

(58) Field of Classification Search
CPC ..... E21B 34/14; E21B 2034/007
See application file for complete search history.

(56) References Cited

U.S. PATENT DOCUMENTS 4,674,569 A * 6/1987 Revils ..... E21B 34/14 166/154
5,960,884 A 10/1999 Echols
(Continued)

FOREIGN PATENT DOCUMENTS

CN 102 345 452 A 2/2012
WO 02068793 A1 9/2002
(Continued)

OTHER PUBLICATIONS

Weatherford Openhole Completions "ZoneSelect Monobore Frac Sliding Sleeve," obtained from www.weatherford.com (c) 2009-2011 brochure No. 6669.03, 2 pages.
(Continued)

*Primary Examiner* — Giovanna C Wright
(74) *Attorney, Agent, or Firm* — Blank Rome, LLP

(57) ABSTRACT

A sliding sleeve opens with a deployed ball. The sleeve has a seat disposed in the housing, and the seat has segments biased outward from one another with a C-ring or other biasing element. Initially, the seat has an expanded state in the sliding sleeve so that the seats segments expand outward against the housing's bore. When an appropriately sized ball is deployed downhole, the ball engages the expanded seat. Fluid pressure applied against the seated ball moves the seat into the inner sleeve's bore. As this occurs, the seat contracts, which increases the engagement area of the seat with the ball. Eventually, the seat reaches the shoulder in the inner sleeve so that pressure applied against the seated ball now moves the inner sleeve in the housing to open the sliding sleeve's flow port.

23 Claims, 21 Drawing Sheets

(51) Int. Cl.
*E21B 43/26* (2006.01)
*E21B 34/00* (2006.01)

(52) U.S. Cl.
CPC ... *E21B 2034/007* (2013.01); *Y10T 137/0318* (2015.04); *Y10T 137/7781* (2015.04)

(56) References Cited

U.S. PATENT DOCUMENTS

| | | | | |
|---|---|---|---|---|
| 6,866,100 | B2 | 3/2005 | Gudmestad et al. | |
| 7,322,417 | B2 | 1/2008 | Rytlewski et al. | |
| 7,377,321 | B2 | 5/2008 | Rytlewski | |
| 7,581,596 | B2 | 9/2009 | Reimert et al. | |
| 7,628,210 | B2 | 12/2009 | Avant et al. | |
| 7,637,323 | B2 | 12/2009 | Schasteen et al. | |
| 7,673,677 | B2 | 3/2010 | King et al. | |
| 2009/0044948 | A1 | 2/2009 | Avant et al. | |
| 2009/0044949 | A1 | 2/2009 | King et al. | |
| 2009/0044955 | A1 | 2/2009 | King et al. | |
| 2009/0159289 | A1 | 6/2009 | Avant et al. | |
| 2009/0308614 | A1 | 12/2009 | Sanchez et al. | |
| 2011/0203800 | A1 | 8/2011 | Tinker | |
| 2011/0259610 | A1 | 10/2011 | Shkurti et al. | |
| 2011/0278017 | A1 | 11/2011 | Themig et al. | |
| 2012/0012771 | A1 | 1/2012 | Korkmaz et al. | |
| 2012/0261115 | A1 | 10/2012 | Xu | |
| 2012/0305236 | A1 | 12/2012 | Gouthaman | |
| 2013/0153220 | A1* | 6/2013 | Carter | E21B 33/128 166/285 |
| 2015/0096767 | A1* | 4/2015 | Atilano | E21B 34/063 166/383 |

FOREIGN PATENT DOCUMENTS

| | | | |
|---|---|---|---|
| WO | 2012149638 | A1 | 11/2012 |
| WO | 2012166928 | A2 | 12/2012 |
| WO | 2014116237 | A1 | 7/2014 |

OTHER PUBLICATIONS

Weatherford "ZoneSelect Fracturing Completion System," obtained from www.weatherford.com (c) 2011 brochure No. 7925.01, 12 pages.

Weatherford Openhole Completions "ZoneSelect SingleShot Frac Sliding Sleeve," obtained from www.weatherford.com (c) 2009-2012 brochure No. 6671.06, 3 pages.

Weatherford Openhole Completions "ZoneSelect MultiShift Frac Sliding Sleeve," obtained from www.weatherford.com (c) 2009-2010 brochure No. 6670.01, 4 pages.

International Search Report received in related PCT case No. PCT/US2013/074891 mail date Oct. 17, 2014.I.

International Search Report received in related PCT case No. PCT/US2013/074894 mail date Oct. 17, 2014.I.

International Search Report received in related PCT case No. PCT/US2013/074896 mail date Oct. 17, 2014.

International Search Report received in related PCT case No. PCT/US2013/074898 mail date Oct. 21, 2014.

International Search Report received in related PCT case No. PCT/US2013/074900 mail date Oct. 17, 2014.

International Search Report received in related PCT case No. PCT/US2013/074903 mail date Oct. 17, 2014.

Baker Hughes, "FracPoint EX-C Frac sleeve system", Oct. 4, 2011, pp. 1-1, XP055145225, Retrieved from the Internet: URL:http://assets.cmp.bh.mxmcloud.com/system/ale5202b0c4beb6e300b59ef805cbfa_33834-fracpointex-c_ovrw_hires.pdf [retrieved on Oct. 8, 2014].

* cited by examiner

SLIDING SLEEVE HAVING CONTRACTING, DUAL SEGMENTED BALL SEAT

CROSS-REFERENCE TO RELATED APPLICATIONS

This application claims the benefit of U.S. Provisional Appl. No. 61/736,993, filed 13, Dec., 2012, which is incorporated herein by reference.

BACKGROUND OF THE DISCLOSURE

In a staged fracturing operation, multiple zones of a formation need to be isolated sequentially for treatment. To achieve this, operators install a fracturing assembly down the wellbore, which typically has a top liner packer, open hole packers isolating the wellbore into zones, various sliding sleeves, and a wellbore isolation valve. When the zones do not need to be closed after opening, operators may use single shot sliding sleeves for the fracturing treatment. These types of sleeves are usually ball-actuated and lock open once actuated. Another type of sleeve is also ball-actuated, but can be shifted closed after opening.

Initially, operators run the fracturing assembly in the wellbore with all of the sliding sleeves closed and with the wellbore isolation valve open. Operators then deploy a setting ball to close the wellbore isolation valve. This seals off the tubing string of the assembly so the packers can be hydraulically set. At this point, operators rig up fracturing surface equipment and pump fluid down the wellbore to open a pressure actuated sleeve so a first zone can be treated.

As the operation continues, operates drop successively larger balls down the tubing string and pump fluid to treat the separate zones in stages. When a dropped ball meets its matching seat in a sliding sleeve, the pumped fluid forced against the seated ball shifts the sleeve open. In turn, the seated ball diverts the pumped fluid into the adjacent zone and prevents the fluid from passing to lower zones. By dropping successively increasing sized balls to actuate corresponding sleeves, operators can accurately treat each zone up the wellbore.

FIG. 1A shows an example of a sliding sleeve 10 for a multi-zone fracturing system in partial cross-section in an opened state. This sliding sleeve 10 is similar to Weatherford's ZoneSelect MultiShift fracturing sliding sleeve and can be placed between isolation packers in a multi-zone completion. The sliding sleeve 10 includes a housing 20 defining a bore 25 and having upper and lower subs 22 and 24. An inner sleeve or insert 30 can be moved within the housing's bore 25 to open or close fluid flow through the housing's flow ports 26 based on the inner sleeve 30's position.

When initially run downhole, the inner sleeve 30 positions in the housing 20 in a closed state. A breakable retainer 38 initially holds the inner sleeve 30 toward the upper sub 22, and a locking ring or dog 36 on the sleeve 30 fits into an annular slot within the housing 20. Outer seals on the inner sleeve 30 engage the housing 20's inner wall above and below the flow ports 26 to seal them off.

The inner sleeve 30 defines a bore 35 having a seat 40 fixed therein. When an appropriately sized ball lands on the seat 40, the sliding sleeve 10 can be opened when tubing pressure is applied against the seated ball 40 to move the inner sleeve 30 open. To open the sliding sleeve 10 in a fracturing operation once the appropriate amount of proppant has been pumped into a lower formation's zone, for example, operators drop an appropriately sized ball B downhole and pump the ball B until it reaches the landing seat 40 disposed in the inner sleeve 30.

Once the ball B is seated, built up pressure forces against the inner sleeve 30 in the housing 20, shearing the breakable retainer 38 and freeing the lock ring or dog 36 from the housing's annular slot so the inner sleeve 30 can slide downward. As it slides, the inner sleeve 30 uncovers the flow ports 26 so flow can be diverted to the surrounding formation. The shear values required to open the sliding sleeves 10 can range generally from 1,000 to 4,000 psi (6.9 to 27.6 MPa).

Once the sleeve 10 is open, operators can then pump proppant at high pressure down the tubing string to the open sleeve 10. The proppant and high pressure fluid flows out of the open flow ports 26 as the seated ball B prevents fluid and proppant from communicating further down the tubing string. The pressures used in the fracturing operation can reach as high as 15,000-psi.

After the fracturing job, the well is typically flowed clean, and the ball B is floated to the surface. Then, the ball seat 40 (and the ball B if remaining) is milled out. The ball seat 40 can be constructed from cast iron to facilitate milling, and the ball B can be composed of aluminum or a non-metallic material, such as a composite. Once milling is complete, the inner sleeve 30 can be closed or opened with a standard "B" shifting tool on the tool profiles 32 and 34 in the inner sleeve 30 so the sliding sleeve 10 can then function like any conventional sliding sleeve shifting with a "B" tool. The ability to selectively open and close the sliding sleeve 10 enables operators to isolate the particular section of the assembly.

Because the zones of a formation are treated in stages with the sliding sleeves 10, the lowermost sliding sleeve 10 has a ball seat 40 for the smallest ball size, and successively higher sleeves 10 have larger seats 40 for larger balls B. In this way, a specific sized ball B dropped in the tubing string will pass though the seats 40 of upper sleeves 10 and only locate and seal at a desired seat 40 in the tubing string. Despite the effectiveness of such an assembly, practical limitations restrict the number of balls B that can be effectively run in a single tubing string.

Depending on the pressures applied and the composition of the ball B used, a number of detrimental effects may result. For example, the high pressure applied to a composite ball B disposed in a sleeve's seat 40 that is close to the ball's outer diameter can cause the ball B to shear right through the seat 40 as the edge of the seat 40 cuts off the sides of the ball B. Accordingly, proper landing and engagement of the ball B and the seat 40 restrict what difference in diameter the composite balls B and cast iron seats 40 must have. This practical limitation restricts how many balls B can be used for seats 40 in an assembly of sliding sleeves 10.

In general, a fracturing assembly using composite balls B may be limited to thirteen to twenty-one sliding sleeves depending on the tubing size involved. For example, a tubing size of 5-½-in. can accommodate twenty-one sliding sleeves 10 for twenty-one different sized composite balls B. Differences in the maximum inner diameter for the ball seats 40 relative to the required outside diameter of the composite balls B can range from 0.09-in. for the smaller seat and ball arrangements to 0.22-in. for the larger seat and ball arrangements. In general, the twenty-one composite balls B can range in size from about 0.9-in. to about 4-in. with increments of about 0.12-in between the first eight balls, about 0.15-in. between the next eight balls, about 0.20-in between the next three balls, and about 0.25-in. between the last two balls. The minimum inner diameters for the twenty-one seats 40 can range in size from about 0.81-in. to about 3.78-in, and the increments between them can be comparably configured as the balls B.

When aluminum balls B are used, more sliding sleeves 10 can be used due to the close tolerances that can be used between the diameters of the aluminum balls B and iron seats 40. For example, forty different increments can be used for sliding sleeves 10 having solid seats 40 used to engage aluminum balls B. However, an aluminum ball B engaged in a seat 40 can be significantly deformed when high pressure is applied against it. Any variations in pressuring up and down that allow the aluminum ball B to seat and to then float the ball B may alter the shape of the ball B compromising its seating ability. Additionally, aluminum balls B can be particularly difficult to mill out of the sliding sleeve 10 due to their tendency of rotating during the milling operation. For this reason, composite balls B are preferred.

The subject matter of the present disclosure is directed to overcoming, or at least reducing the effects of, one or more of the problems set forth above.

SUMMARY OF THE DISCLOSURE

A sliding sleeve opens with a deployed plug (e.g., ball). The inner sleeve is disposed in the housing's bore and is movable axially relative to a flow port in the housing from a closed position to an opened position. A seat disposed in the sliding sleeve engages the deployed ball and opens the inner sleeve axially when initial fluid pressure is applied against the seated ball.

Once the sliding sleeve is opened, subsequent fluid pressure applied against the seated ball for a fracturing or other treatment operation acts against the seated ball. The seat, which initially supported the ball with an initial contact area or dimension, then transforms in response to the subsequent pressure to a greater contact area or narrower dimension, further supporting the ball in the seat.

In one embodiment, the seat has segments biased outward from one another. Initially, the seat has an expanded state in the sliding sleeve so that the seats segments expand outward against the housing's bore. When an appropriately sized ball is deployed downhole, the ball engages the expanded seat. Fluid pressure applied against the seated ball moves the seat into the inner sleeve's bore. As this occurs, the seat contracts, which increases the engagement area of the seat with the ball. Eventually, the seat reaches a shoulder in the inner sleeve so that pressure applied against the seated ball now moves the inner sleeve in the housing to open the sliding sleeve's flow port.

The seat has at least one biasing element that biases the segments outward from one another, and this biasing element can be a split ring having the segments disposed thereabout. To help contract the segmented seat when moved into the inner sleeve, the housing can have a spacer ring separating the seat in the initial position from the inner sleeve in the closed position.

The sliding sleeve can be used in an assembly of similar sliding sleeves for a treatment operation, such as a fracturing operation. In the fluid treatment operation, the sliding sleeves are disposed in the wellbore, and increasingly sized balls are deployed downhole to successively open the sliding sleeves up the tubing string. When deployed, the ball engages against the seat expanded in the sliding sleeve that the ball is sized to open. The seat contracts from its initial position in the sliding sleeve to a lower position in the inner sleeve inside the sliding sleeve when fluid pressure is applied against the ball engaged against the seat. Then, the inner sleeve inside the sliding sleeve moves to an opened position when fluid pressure is applied against the ball engaged against the seat contracted in the inner sleeve.

In another embodiment, a seat disposed in a bore of the inner sleeve can move axially from a first position to a second position therein. The seat has a plurality of segments, and each segment has an inclined surface adapted to engage the inner-facing surface. The segments in the first position expand outward from one another and define a first contact area engaging the deployed ball. The seat moves the inner sleeve to the opened position in response to fluid pressure applied against the engaged ball. In particular, the segments move from the first position to the second position once in the inner sleeve in the opened position in response to second fluid pressure applied against the engaged ball. The segments in the second position contract inward by engagement of the segment's inclined surfaces with the sleeve's inner-facing surface and define a second contact area engaging the deployed ball greater than the first contact area.

In another embodiment, a seat disposed in a bore of the inner sleeve has a landing ring disposed in the bore and being movable axially from a first axial position to a second axial position therein. A compressible ring, which can have segments, is also disposed in the bore and defines a space between a portion of the compressible ring and the bore. The landing ring in the first position supports the deployed ball with a first contact dimension and moves the inner sleeve to the opened position in response to application of first fluid pressure against the engaged ball. The landing ring moves from the first position to the second position in the inner sleeve when in the opened position in response to second fluid pressure applied against the engaged ball. The landing ring in the second position fits in the space between the compressible ring and the second bore and contracts the compressible ring inward. For example, the landing ring fit in the space moves the segments of the compressible ring inward toward one another. As a result, the segments moved inward support the engaged ball with a second contact dimension narrower than the first contact dimension.

In another embodiment, a movable ring is disposed in a bore of an inner sleeve adjacent the shoulder. The movable ring engages a deployed ball with a first contact area and moves the inner sleeve open with the deployed ball. A deformable ring, which can be composed of an elastomer or the like, is also disposed in the inner sleeve's bore between the shoulder and the movable ring. With the application of increased pressure, the movable ring moves in the inner sleeve with the deployed ball toward the shoulder, and the deformable ring deforms in response to the movement of the movable ring toward the shoulder. As a result, the deformable ring engages the deployed ball when deformed and increases the engagement with the deployed ball to a second contact area greater than the first contact area.

In another embodiment, a seat disposed in an inner sleeve has a -conical shape with a top open end and a base open end. For example, the seat can include a frusto-conical ring. The seat has an initial state with the top open end disposed more toward the proximal end of the inner sleeve than the bottom open end. In this initial state, the seat engages the deployed ball with a first contact area and moves the inner sleeve open in response to first fluid pressure applied against the deployed ball in the seat. As this occurs, the seat deforms at least partially from the initial state to an inverted state in the opened inner sleeve in response to second fluid pressure applied against the deployed ball. In this inverted state, the seat engages the deployed ball with a second contact area greater than the first contact area.

In another embodiment, a compressible seat, which can include a split ring, is disposed in a first position in the inner sleeve and has an expanded state to engage the deployed ball with a first contact area. When engaged by a ball, the compressible seat shifts from the first position to the second position against the engagement point and contracts from the expanded state to a contracted state in response to fluid pressure applied against the deployed ball in the compressible seat. In the contracted state, the compressible seat engages the deployed ball with a second contact area greater than the first surface contact area.

The foregoing summary is not intended to summarize each potential embodiment or every aspect of the present disclosure.

DETAILED DESCRIPTION OF THE DISCLOSURE

A. Sliding Sleeve Having Contracting, Segmented Ball Seat

Figure 1A:
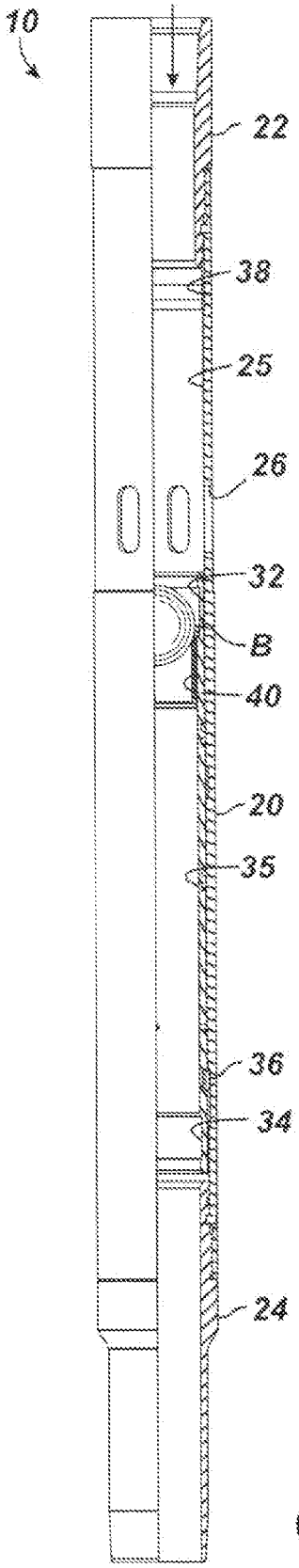
FIG. 1A (Prior Art)
FIG. 1A illustrates a sliding sleeve having a ball engaged with a seat to open the sliding sleeve according to the prior art.
Figure 1B:
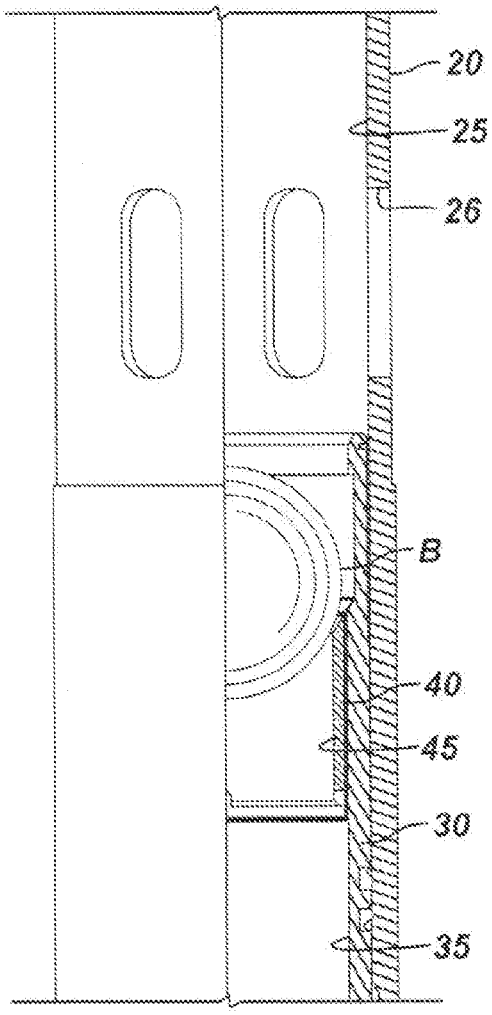
FIG. 1B (Prior Art)
FIG. 1B illustrates a close up view of the sliding sleeve in FIG. 1B.
Figure 2A:
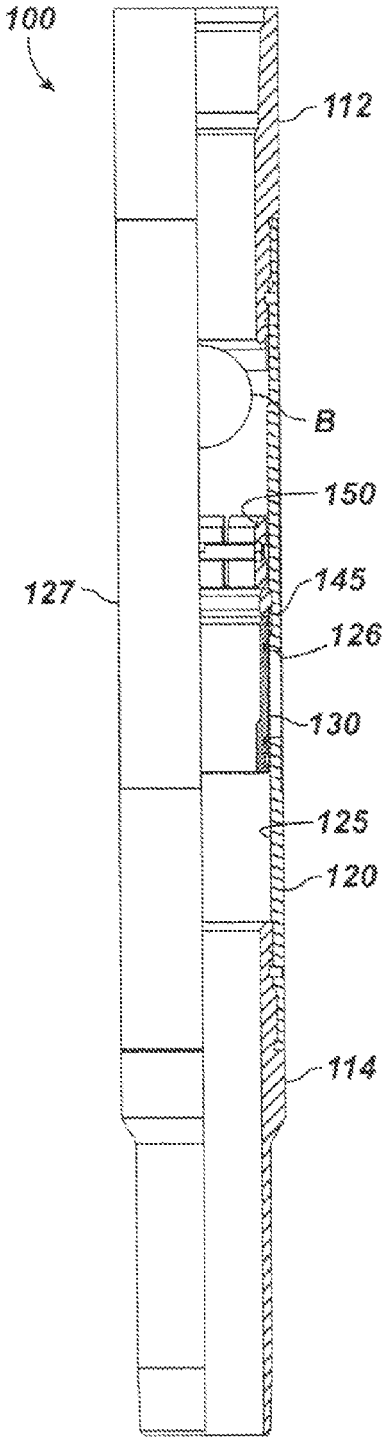
FIG. 2A illustrates a sliding sleeve in a closed condition having a compressible, segmented seat according to the present disclosure in a first position.
Figure 2B:
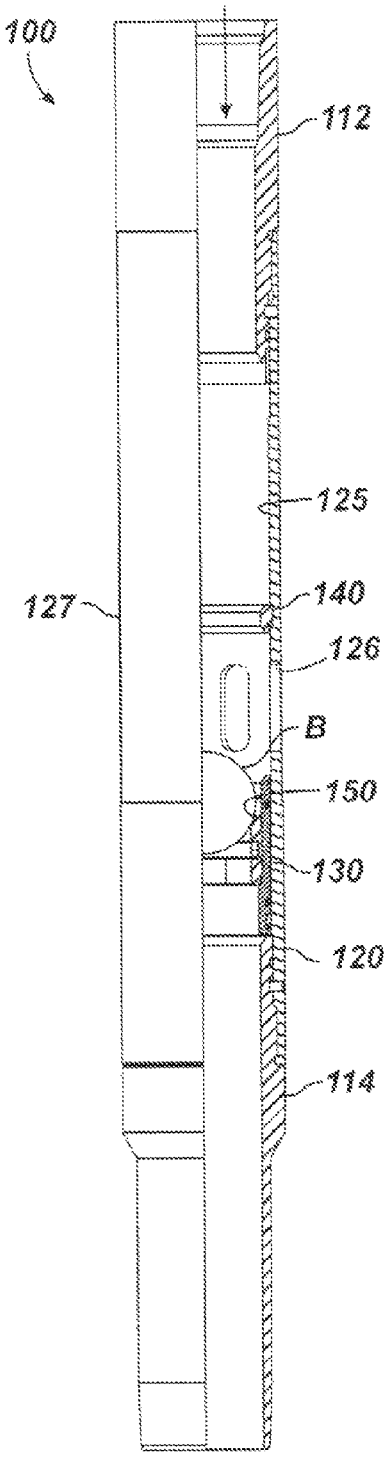
FIG. 2B illustrates the sliding sleeve of FIG. 2A in an opened condition having the compressible, segmented seat in a second position.

FIG. 2A illustrates a sliding sleeve 100 in a closed condition and having a seat 150 according to the present disclosure in a first (upward) position, while FIG. 2B illustrates the sliding sleeve 100 in an opened condition and having the seat 150 in a second (downward) position. The sliding sleeve 100 can be part of a multi-zone fracturing system, which uses the sliding sleeve 100 to open and close communication with a borehole annulus. In such an assembly, the sliding sleeve 100 can be placed between isolation packers in the multi-zone completion.

The sliding sleeve 100 includes a housing 120 with upper and lower subs 112 and 114. An inner sleeve or insert 130 can move within the housing 120 to open or close fluid flow through the housing's flow ports 126 based on the inner sleeve 130's position.

When initially run downhole, the inner sleeve 130 positions in the housing 120 in a closed state, as in FIG. 2A. A retaining element 145 temporarily holds the inner sleeve 130 toward the upper sub 112, and outer seals 132 on the inner sleeve 130 engage the housing 120's inner wall both above and below the flow ports 126 to seal them off. As an option, the flow ports 126 may be covered by a protective sheath 127 to prevent debris from entering into the sliding sleeve 100.

The sliding sleeve 100 is designed to open when a ball B lands on the landing seat 150 and tubing pressure is applied to move the inner sleeve 130 open. (Although a ball B is shown and described, any conventional type of plug, dart, ball, cone, or the like may be used. Therefore, the term "ball" as used herein is meant to be illustrative.) To open the sliding sleeve 100 in a fracturing operation, for example, operators drop an appropriately sized ball B downhole and pump the ball B until it reaches the landing seat 150 disposed in the inner sleeve 130.

Figure 3:
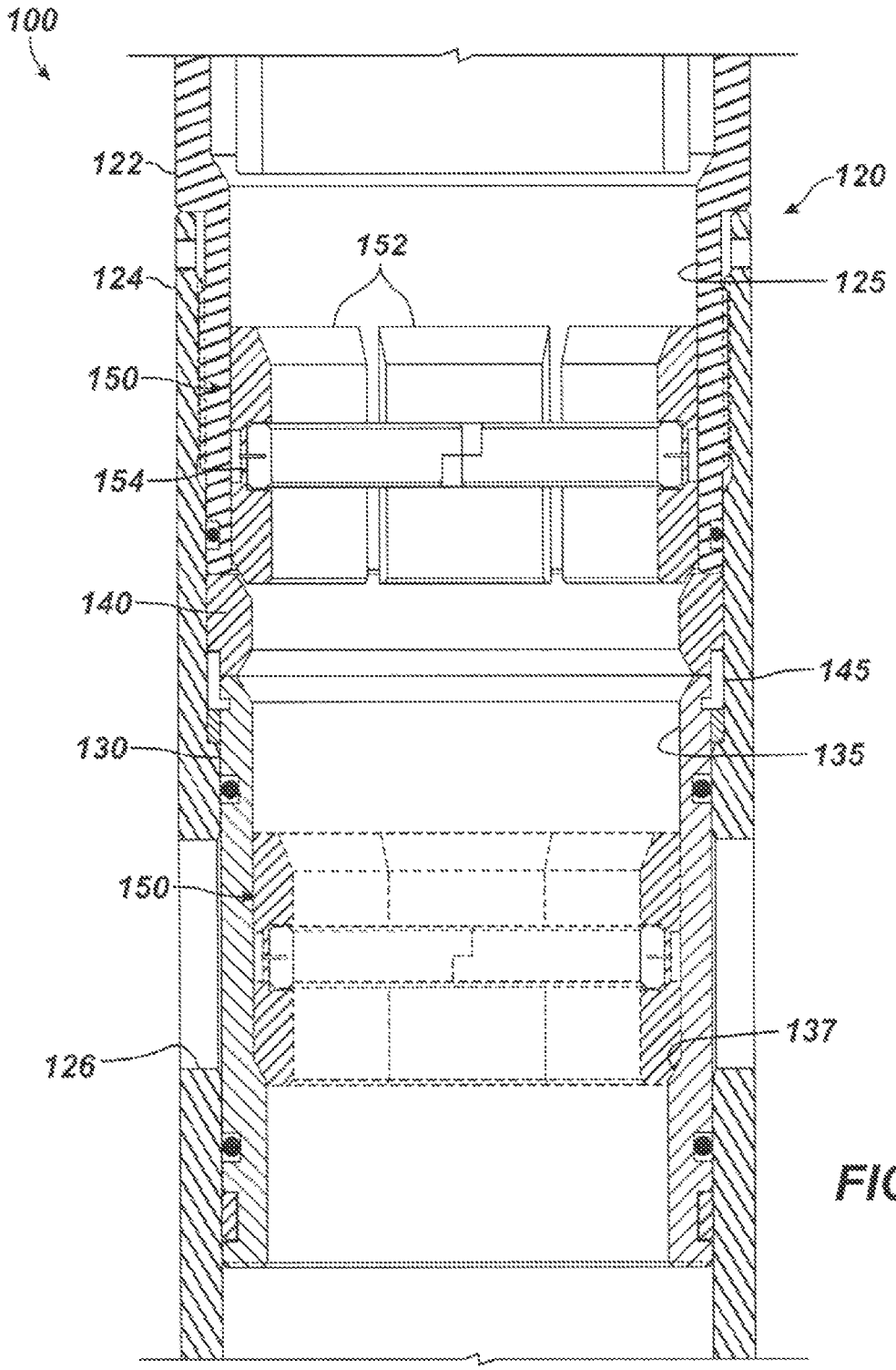
FIG. 3 illustrates portion of the sliding sleeve of FIGS. 2A-2B showing the compressible, segmented seat in its first and second positions.

The seat 150 only requires a certain amount of surface area to initially engage the ball B. Yet, additional surface area is provided to properly seat the ball B and open the inner sleeve 130 when pressure is applied. As shown in FIG. 3, for example, the seat 150 is shown in two positions relative to the inner sleeve 130 and in two states. In an initial position, the seat 150 disposes in the bore 125 of the housing 120 and has an expanded state. To assemble the sliding sleeve 100 with the seat 150 installed, the housing 120 has an upper housing component 122 that threads and affixes to a lower housing component 122 near the location of the seat 150 and other components discussed herein.

The seat 150 in the expanded state and in its upper position engages against the deployed ball B and engages in a contracted state in the lower position against the deployed ball and the inner sleeve 130. To do this, the seat 150 has a plurality of segments 152 disposed about the inside surface of the housing's bore 125. A split ring, C-ring, or other biasing element 154 is disposed around the inside surfaces of the segments 152, preferably in slots, and pushes the segments 152 outward against the surrounding surface.

In the initial, upper position, the segments 152 are pushed outward to the expanded state by the split ring 154 against the inside surface of the housing's bore 125. To prevent a build-up of debris from getting into the segments 152 and to prevent potential contraction of the segments 152, the gaps between the segments 152 of the seat 150 can be filed with packing grease, epoxy, or other filler.

When moved downward relative to the housing 120 as depicted in dashed lines in FIG. 3, the seat 150 is contracted to its contracted state inside the bore 135 of the inner sleeve 130. When in this second position, the segments 152 of the contracted seat 150 are pushed outward by the split ring 154 against the inside surface of the sleeve's bore 135.

Figure 4B:
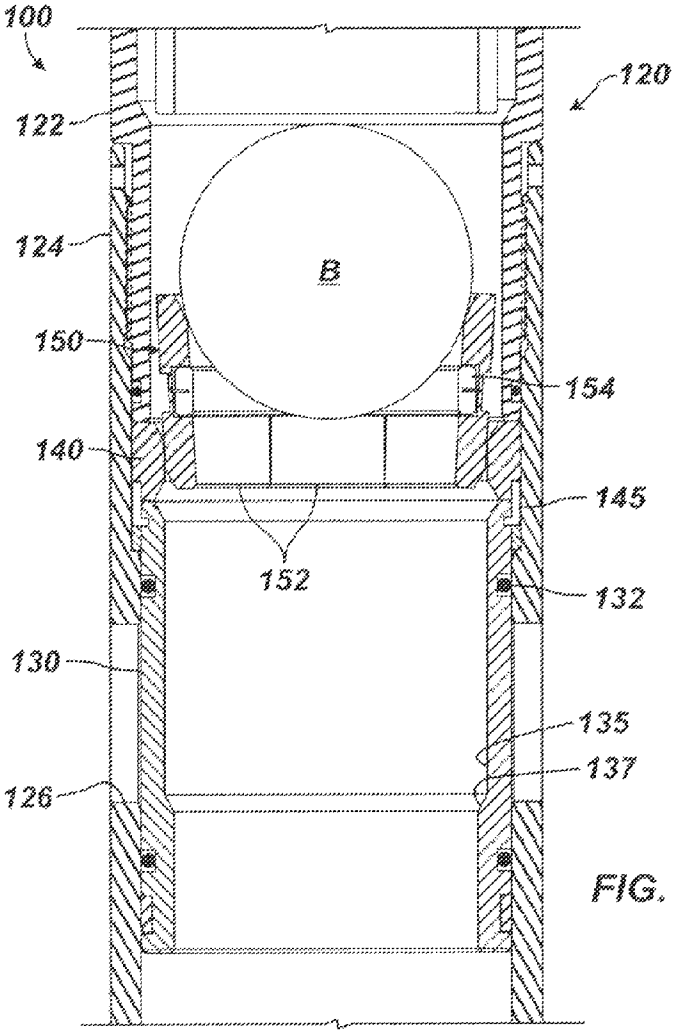
FIGS. 4A-4D illustrate portions of the sliding sleeve of FIGS. 2A-2B showing the compressible, segmented seat being moved from the first and second positions to open the sliding sleeve.
Figure 4A:
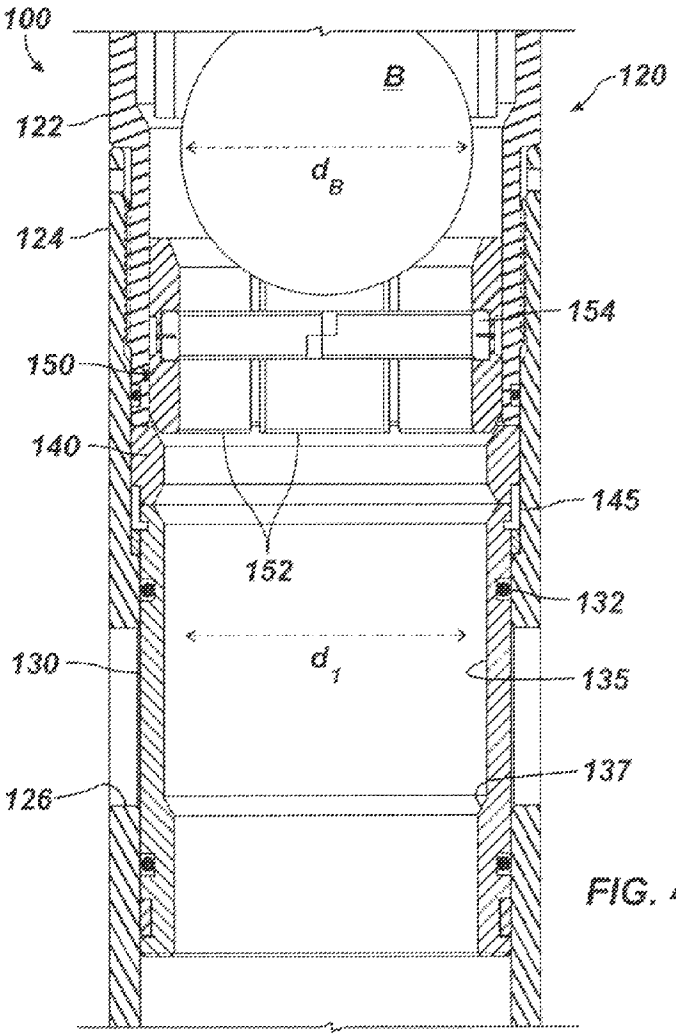

In the run-in condition while the inner sleeve 130 is closed, the segmented seat 150 rests in the upper position expanded against the housing's bore 125, which allows balls of a smaller size to pass through the seat 150 unengaged. A spacer ring 140 disposed inside the housing 120 separates the seat 150 from the inner sleeve 130, and a retaining element 145 on the spacer ring 140 temporarily holds the inner sleeve 130 in its closed position. FIG. 4A shows portion of the sliding sleeve 100 having the seat 150 set in this initial position and having the inner sleeve 130 closed.

As shown, the segments 152 of the seat 150 in the initial position expand outward against the larger bore 125 of the housing 120. When the seat 150 moves past the spacer ring 140 and into the inner sleeve 130, the segments 152 contract inward against the bore 135 of the inner sleeve 130. Transitioning over the fixed spacer ring 140 is preferred. However, other arrangements can be used. For example, the inner sleeve 130 can be longer than depicted to hold the expanded seat 150 in portion of the inner sleeve 130 for initially engaging the ball B. In this case, the segments 152 of the seat 150 in the initial position can expand outward against the bore 135 of the inner sleeve 130. Then, the segments 152 can pass a transition (not shown) in the inner sleeve 130 and contract inward inside a narrower dimension of the inner sleeve's bore 130.

Once the ball B of a particular size is dropped downhole to the sliding sleeve 100, the ball B seats against the angled ends of the segments 152, which define an engagement area smaller than the internal bore 125 of the housing 120. FIG. 4A shows the ball B as it is being deployed toward the seat 150 in its initial position. Notably, the segments 152 in the first position define an inner dimension ($d_1$) being approximately ⅛-in. narrower than an outer dimension ($d_B$) of the deployed ball B.

Once the ball B seats, built up pressure behind the seated ball B forces the ball B against the seat 150. Eventually, the pressure can cause the seat 150 to shear or break free of a holder (if present) and move against the chamfered edge of the spacer ring 140. Rather than pushing against the inner sleeve 130 during this initial movement, the seat 150 instead contracts to its contracted state as the segments 152 come together against the bias of the split ring 154 as the seat 150 transitions past the spacer ring 140.

With continued pressure, the seat 150 with the ball B now moves downward into the bore 135 of the inner sleeve 130. FIG. 4B shows the seat 150 moved to a subsequent position within the inner sleeve 130. As can be seen, the contraction of the seat 150 increases the surface area of the seat 150 for engaging against the ball B. In particular, the top, inside edges of the segments 152 in the initial position (FIG. 4A) define a first contact dimension ($d_1$) for contacting the deployed ball B. When the segments 152 move to the subsequent and then final positions (FIGS. 4B-4D), however, the ends of the segments 152 define a second contact dimension ($d_2$) narrower than the first contact dimension ($d_1$). Moreover, the ends of the segments 152 encompass more surface area of the deployed ball B.

Notably, the sliding of the segments 152 in the bore 135, the contraction of the segments 152 inward, and the pressure applied against the seated ball B together act in concert to wedge the ball B in the seat 150. In other words, as the segments 152 transition from the initial position (FIG. 4A) to the subsequent positions (FIGS. 4B-4D), the segments 152 tend to compress against the sides of the deployed ball B being forced into the segments 152 and forcing the segments 152 to slide. Thus, the segments 152 not only support the lower end of the ball B, but also tend to squeeze or press against the sides of the ball B, which may have initially been able to fit somewhat in the seat 150 while the segments 152 were expanded and may be subsequently squeezed and deformed.

This form of wedged support has advantages for both aluminum and composite balls B. The wedged support can increase the bearing area on the ball B and can help the ball B to stay seated and withstand high pressures. Wedging of an aluminum ball B may make it easier to mill out the ball B, while wedging of the composite balls B can avoid the possible shearing or cutting of the ball's sides that would the ball B to pass through the seat 150.

Figure 4D:
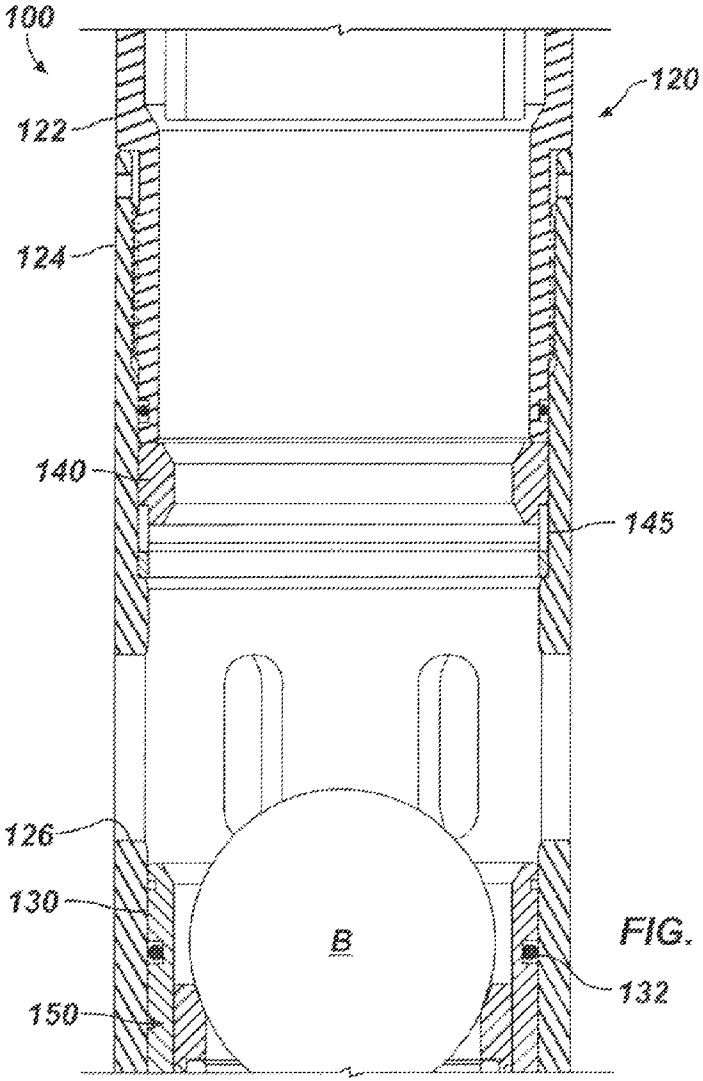
Figure 4C:
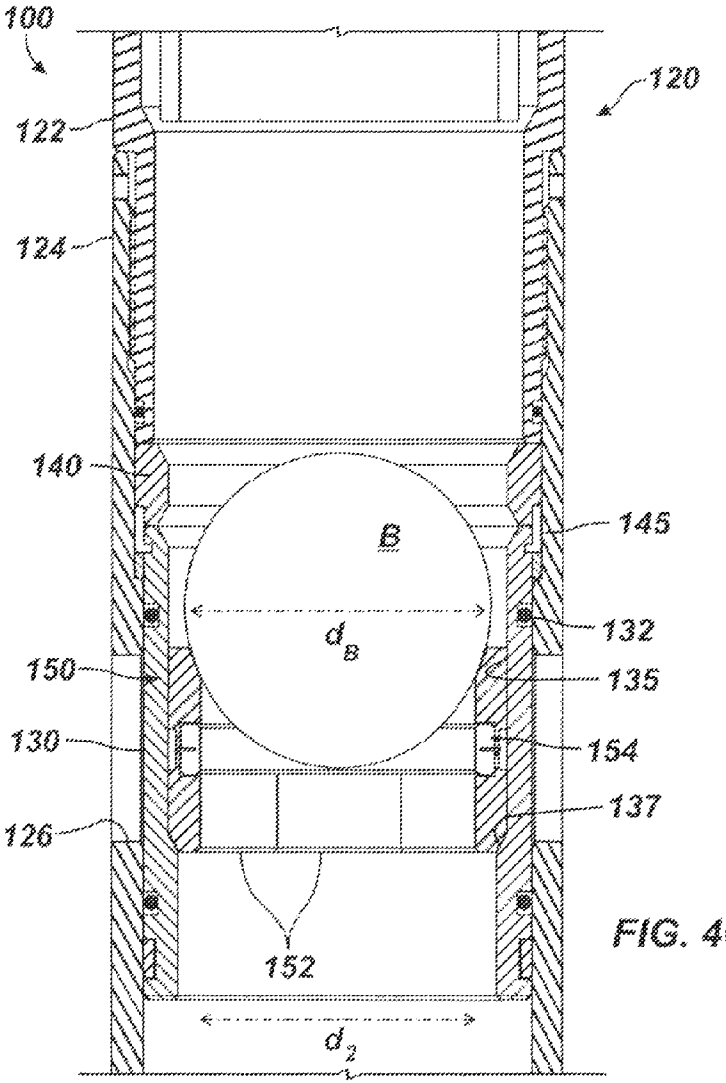

Continued pressure eventually moves the seat 150 against an inner shoulder 137 of the sleeve's bore 135. The engagement causes the movement of the seat 150 in the sleeve's bore 135 to stop. FIG. 4C shows the seat 150 moved in the inner sleeve 130 against the inner shoulder 137.

Now, the pressure applied against the ball B forces the inner sleeve 130 directly so that the inner sleeve 130 moves from the closed condition to the opened condition. As it slides in the housing's bore 125, the inner sleeve 130 uncovers the flow ports 126 of the housing 120 and places the bore 125 in fluid communication with the annulus (not shown) surrounding the sliding sleeve 100. FIG. 4D shows the sleeve 130 moved to the open condition.

Fracturing can then commence by flowing treatment fluid, such as a fracturing fluid, downhole to the sliding sleeve 100 so the fluid can pass out the open flow ports 126 to the surrounding formation. The ball B engaged in the seat 150 prevents the treatment fluid from passing and isolates downhole sections of the assembly. Yet, the ends of the segments 152 encompassing more surface area of the deployed ball B helps support the ball B at the higher fluid pressure used during treatment (e.g., fracturing) operations through the sliding sleeve 100.

It should be noted that the support provided by the seat 150 does not need to be leak proof because the fracturing treatment may merely need to sufficiently divert flow with the seated ball B and maintain pressures. Accordingly, the additional engagement of the ball B provided by the contracted seat 150 is intended primarily to support the ball B at higher fracturing pressures. Moreover, it should be noted that the ball B as shown here and throughout the disclosure may not be depicted as deformed. This is merely for illustration. In use, the ball B would deform and change shape from the applied pressures.

Once the treatment is completed for this sliding sleeve 100, similar operations can be conducted uphole to treat other sections of the wellbore. After the fracturing job is completed, the well is typically flowed clean, and the ball B is floated to the surface. Sometimes, the ball B may not be floated or may not dislodge from the seat 150. In any event, the seat 150 (and the ball B if remaining) is milled out to provide a consistent inner dimension of the sliding sleeve 100.

To facilitate milling, the seat 150 and especially the segments 152 can be constructed from cast iron, and the ball B can be composed of aluminum or a non-metallic material, such as a composite. The split ring 154 can be composed of the same or different material from the segments 152. Preferably, the split ring 154 can be composed of a suitable material to bias the segments 152 that can be readily milled as well. For example, the split ring 154 can be composed of any suitable material, such as an elastomer, a thermoplastic, an organic polymer thermoplastic, a polyetheretherketone (PEEK), a thermoplastic amorphous polymer, a polyamide-imide, TORLON®, a soft metal, cast iron, etc., and a combination thereof. (TORLON is a registered trademark of SOLVAY ADVANCED POLYMERS L.L.C.)

Once milling is complete, the inner sleeve 130 can be closed or opened with a shifting tool. For example, the inner sleeve 130 can have tool profiles (not shown) so the sliding sleeve 100 can function like any conventional sliding sleeve that can be shifted opened and closed with a convention tool, such as a "B" tool. Other arrangements are also possible.

As noted above, proper landing and engagement of the ball B and the seat 150 define what difference in diameters the ball B and seat 150 must have. By adjusting the difference between what initial area is required to first seat the ball B on the segmented seat 150 in the expanded state and what subsequent area of the seat 150 in the contracted state is required to then move the sleeve 130 open, the sliding sleeve 100 increases the number of balls B that can be used for seats 150 in an assembly of sliding sleeves 100, regardless of the ball's composition due to the wedging engagement noted herein.

Other than the split ring 154 as depicted, another type of biasing element can be used to bias the segments 152 toward expansion. For example, the segments 152 can be biased using biasing elements disposed between the adjacent edges of the segments 152. These interposed biasing elements, which can be springs, elastomer, or other components, push the segments 152 outward away from one another so that the seat 150 tends to expand.

This sliding sleeve 100 can ultimately reduce the overall pressure drop during a fracturing operation and can allow operators to keep up flow rates during operations.

Figure 5:
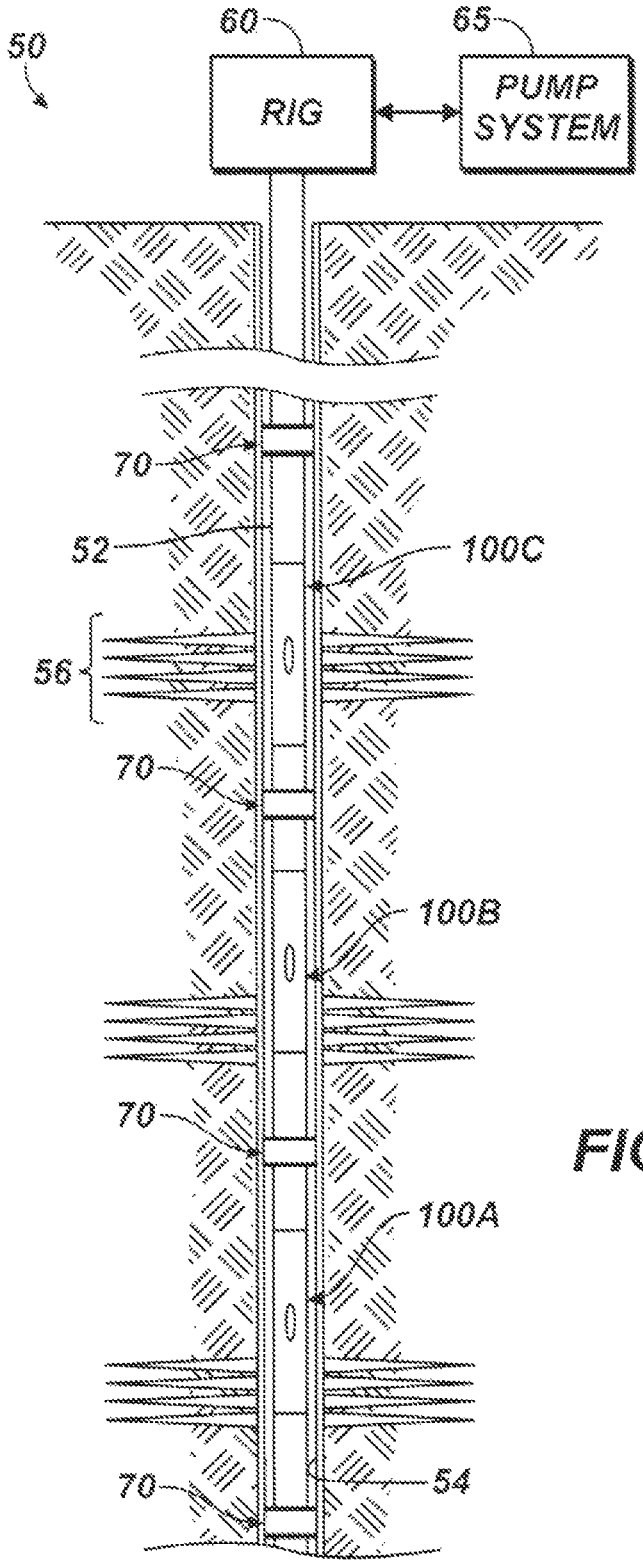
FIG. 5 illustrates a fracturing assembly having a plurality of sliding sleeves according to the present disclosure.

As an example, FIG. 5 shows a fracturing assembly 50 using the present arrangement of the segmented seat (150) in sliding sleeves (100A-C) of the assembly 50. As shown, a tubing string 52 deploys in a wellbore 54. The string 52 has several sliding sleeves 100A-C disposed along its length, and various packers 70 isolate portions of the wellbore 54 into isolated zones. In general, the wellbore 54 can be an opened or cased hole, and the packers 70 can be any suitable type of packer intended to isolate portions of the wellbore into isolated zones.

The sliding sleeves 100A-C deploy on the tubing string 52 between the packers 70 and can be used to divert treatment fluid selectively to the isolated zones of the surrounding formation. The tubing string 52 can be part of a fracturing assembly, for example, having a top liner packer (not shown), a wellbore isolation valve (not shown), and other packers and sleeves (not shown) in addition to those shown. If the wellbore 54 has casing, then the wellbore 54 can have casing perforations 56 at various points.

As conventionally done, operators deploy a setting ball to close the wellbore isolation valve (not shown) lower downhole. The seats in each of the sliding sleeves 100A-C allow the setting ball to pass therethrough. Then, operators rig up fracturing surface equipment 65 and pump fluid down the wellbore 54 to open a pressure actuated sleeve (not shown) toward the end of the tubing string 52. This treats a first zone of the wellbore.

In later stages of the operation, operators successively actuate the sliding sleeves 100A-C between the packers 70 to treat the isolated zones. In particular, operators deploy successively larger balls down the tubing string 52. Each ball is configured to seat in one of the sliding sleeves 100A-C successively uphole along the tubing string 52. Each of the seats in the sliding sleeves 100A-C can pass those ball intended for lower sliding sleeves 100A-C.

Due to the initial expanded state of the seats and the subsequent contracted state, the sliding sleeves 100A-B allow for more balls to be used than conventionally available. Although not all shown, for example, the assembly 50 can have up to 21 sliding sleeves. Therefore, a number of 21 balls can be deployed downhole to successively open the sliding sleeves 100. The various ball sizes can range from 1-inch to 4-in. in diameter with various step differences in between individual balls B. The initial diameters of the seats (150) inside the sliding sleeve 100 can be configured with an ⅛-inch interference fit to initially engage a corresponding ball B deployed in the sliding sleeve 100. The interference fit then increases as the seat transforms from a retracted state to a contracted state. However, the tolerance in diameters for the seat (150) and balls B depends on the number of balls B to be used, the overall diameter of the tubing string 52, and the differences in diameter between the balls B.

The sliding sleeves 100 for the fracturing assembly in FIG. 5 can use other contracting seats as disclosed herein. To that end, discussion turns to FIGS. 6A through 16C showing additional sliding sleeves 100 having contracting seats for moving a sleeve or insert 130 in the sleeve's housing 120 to open flow ports 126. Same reference numerals are used for like components between embodiments of the various sleeves. Additionally, components of the disclosed seats can be composed of iron or other suitable material to facilitate milling.

B. Sliding Sleeve Having Ramped, Contracting, Segmented Ball Seat

The sliding sleeve 100 illustrated in FIGS. 6A-6B and 7A-7B has a ramped seat 160 according to the present disclosure. As before, the sliding sleeve 100 opens with a particularly sized ball B deployed in the sleeve 100 when the deployed ball B engages the ramped seat 160, fluid pressure is applied against the seated ball B, and the inner sleeve 130 shifts open relative to the flow ports 126.

The ramped seat 160 includes a spacer ring 162, ramped segments 164, and a ramped sleeve or ring 168, which are disposed in the sleeve's internal bore 135. The spacer ring 162 is fixed in the sliding sleeve 100 and helps to protect the segments 164 from debris and to centralize the dropped balls passing to the seat 160. Although shown disposed in the inner sleeve 130, the spacer ring 162 may be optional and may be disposed in the housing's bore 125 toward the proximal end of the inner sleeve 130. If practical, the inner bore 135 of the inner sleeve 130 may integrally form the spacer ring 162.

The ramped sleeve 168 is fixed in the sliding sleeve 100 and has an inner-facing surface or ramp 169 that is inclined from a proximal end toward a distal end of the inner sleeve 130. The incline of the ramp 169 can be about 15 to 30-degrees, but other inclines may be used for a given implementation. Rather than having a separate ramped sleeve 168 as shown, the inner sleeve 130 can have the ramp 169 integrally defined inside the bore 135 and inclined from the sleeve's proximal end to its distal end.

Figure 6B:
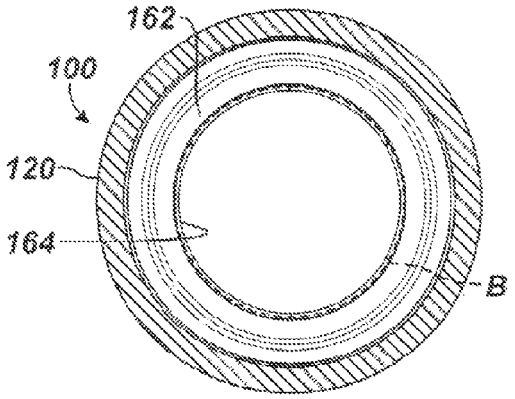
FIGS. 6A-6B illustrate cross-section and end-section views of a sliding sleeve in a closed condition having a ramped seat according to the present disclosure.
Figure 7B:
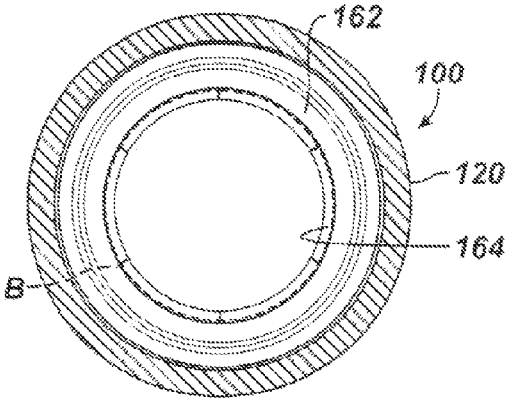
FIGS. 7A-7B illustrate cross-section and end-section views of the sliding sleeve with the ramped seat of FIGS. 6A-6B in an opened condition.
Figure 6A:
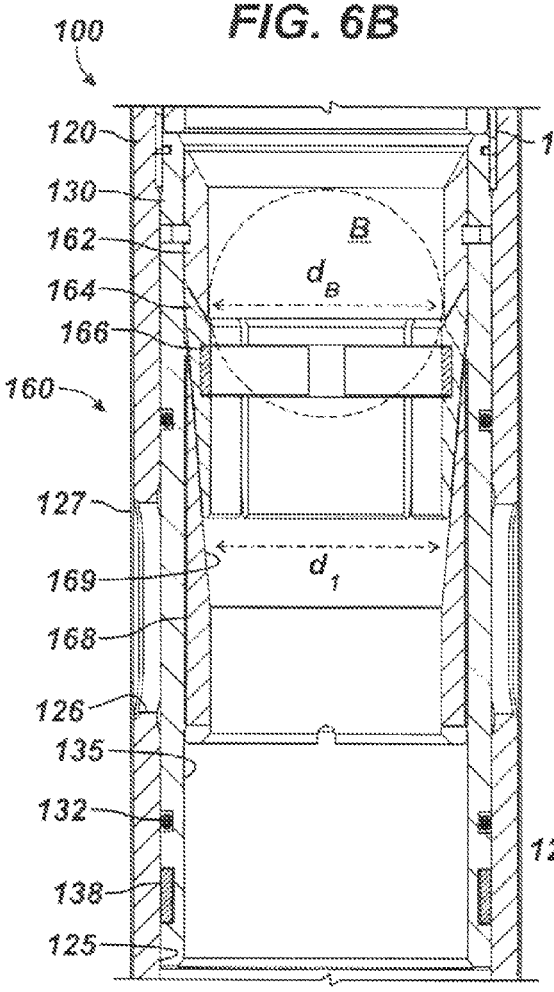
Figure 7A:
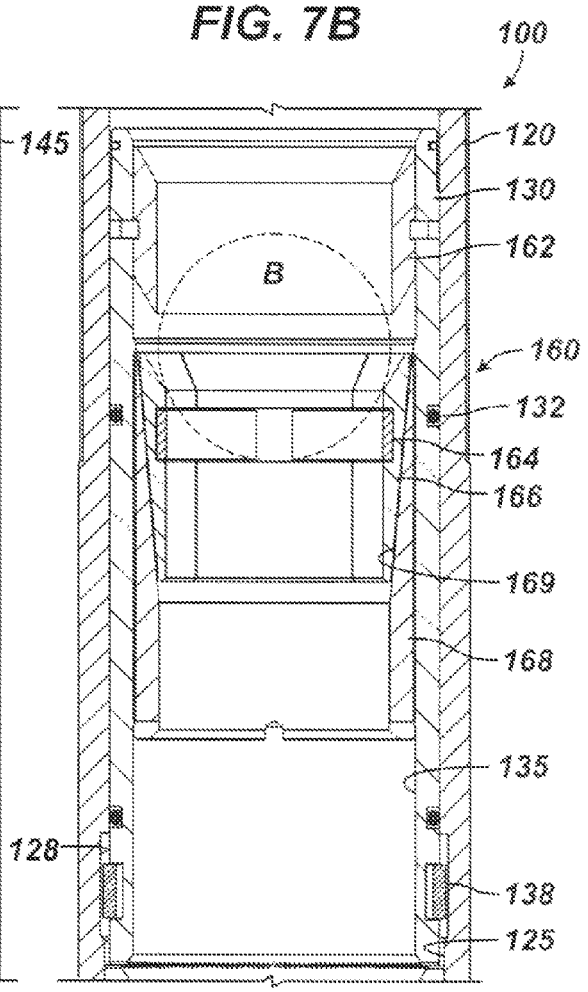

The ramped segments 164, which can be independent segments, are disposed between the spacer ring 162 and the ramped sleeve 168 and can move in the bore 135 from a retracted condition (FIGS. 6A-6B) to an extended or contracted condition (FIGS. 7A-7B). Preferably, one or more biasing elements 166 bias the several ramped segments 164 outward against the inside of the bore 135. A shown here, a biasing ring 166 can be disposed about the segments 164. The biasing ring 166 can be a split ring, snap ring, or C-ring 166, although any other type of biasing element can be used, such as an elastomeric ring or the like. The split ring 166 can be composed of any suitable material, such as cast iron, TORLON®, PEEK, etc., as noted previously. Disposed about the segments 164, the biasing ring 166 can be disposed in slots on the insides surfaces of the segments 164 as shown, or the biasing ring 166 can be disposed through the segments or affixed around the outside of the segments 164.

When biased outward to the retracted condition shown in FIGS. 6A-6B, the ramped segments 164 define an internal diameter or dimension ($d_1$) smaller than that of the spacer ring 162 so that the top ends of the ramped segments 164 form an initial seating surface to engage an appropriately sized ball. As shown in FIGS. 6A-6B, the ball B engages the exposed top surfaces (and more particularly the edges) of the ramped segments 164, creating an initial seating engagement.

The upper edges of the segments 164 expanded outward from one another define a first internal dimension ($d_1$) that is narrower than an outer dimension ($d_B$) of the deployed ball B. The actual difference used between the first internal dimension ($d_1$) and the outer dimension ($d_B$) can depend on the overall diameter in question. For example, the difference between the ball's the outer dimension ($d_B$) and the seat's first internal dimension ($d_1$) may have about 3 or 4 intervals of about 0.09-in., 0.12-in., 0.17-in., and 0.22-in. that increase with ball size from about 0.9-in. to about 4-in., although any other set and range of dimensions can be used. The spacer ring 162, which helps centralize the deployed ball B, has an inner dimension larger than the inner dimension ($d_1$) of the seat's segments 164 so that a contact area of the segments 164 for engaging the deployed ball B is exposed in the sliding sleeve 100.

Fluid pressure applied in the sleeve's bore 125 acts against the seated ball B. The ramped segments 164 are forced against the ramp 169 of the ramped sleeve 168, but the pressure may not be enough to significantly wedge the segments 164 on the ramp 169 due to friction and the force of the split ring 166. To control when and at what pressure the segments 164 wedge against the ramp 169, one or more of the segments 164 may be held by shear pins or other temporary attachment (not shown), requiring a particular force to free the segments 164. At the same time, the applied pressure against the seated ball B forces the inner sleeve 130 in the bore 125 against the temporary retainer 145.

Eventually, the temporary retainer 145 breaks, freeing the inner sleeve 130 to move in the bore 125 from the closed condition (FIG. 6A) to the opened condition (FIG. 7A). In this and other sliding sleeves 100 disclosed herein, the shear values required to open the sliding sleeve 100 can range generally from 1,000 to 4,000 psi.

With the inner sleeve 130 free to move, the applied pressure opens the sleeve 130 relative to the flow ports 126. Because the fluid pressure is being applied to moving the sleeve 130 open, however, the ramped segments 164 may not significantly slide against the ramp 169 of the ramped sleeve 168. Therefore, the upper edges of the segments 164 in their expanded state outward from one another essentially define a contact area between the ball B and the seat 160 when opening the inner sleeve 130.

Figure 8B:
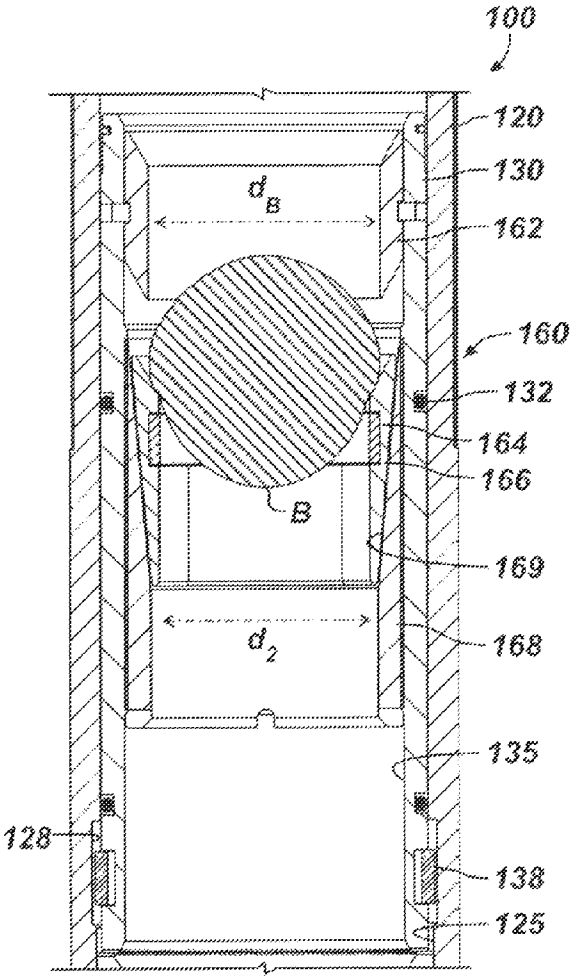
FIGS. 8A-8B illustrate cross-section views of the sliding sleeve with the ramped seat of FIGS. 6A-6B as the seat tends to squeeze the dropped ball.
Figure 8A:
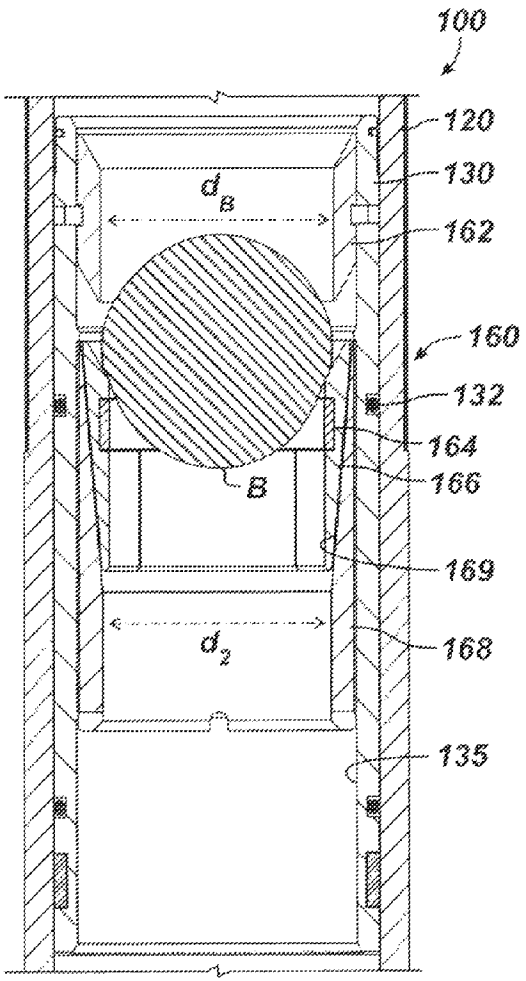

FIG. 8A shows engagement of the ball B primarily with the upper edges of the segments 164.

Once the sliding sleeve 100 is open, operations begin pumping higher pressure treatment (e.g., fracturing fluid) downhole to the open sleeve 100. In this and other embodiments of sliding sleeves 100 disclosed herein, the pressures used in the fracturing operation can reach as high as 15,000-psi. With the increased pressure applied, the ramped segments 164 push against the ramp 169 of the ramped sleeve 168, which causes the segments 164 to contract inward against the bias of the biasing ring 166. As this occurs, the contact area that the segments 164 engage against the ball B increases, creating a more stable engagement. In particular, the contact area of the segments 164 contracted inward toward one another encompasses more surface area than the mere edges of the segments 164 initially used to engage the ball B.

FIG. 8B shows engagement of the ball B with the segments 164 contacted inward.

Moreover, the segments 164 contracted inward define a narrower dimension ($d_2$) than the edges initially used on the segments 164 to engage the ball B. In fact, the edges of the segments 164 contracted inward toward one another can define a second internal dimension ($d_2$) that is narrower than the outer dimension ($d_B$) of the deployed ball. Again, the actual difference used between the second internal dimension ($d_2$) and the outer dimension ($d_B$) can depend on the overall diameter in question. For example, the difference between the ball's the outer dimension ($d_B$) and the seat's second internal dimension ($d_2$) may have about 3 or 4 intervals that are less than the initial difference intervals noted above of 0.09-in., 0.12-in., 0.17-in., and 0.22-in., although any other set and range of dimensions can be used. This provides more stability for supporting the engaged ball B with the seat 160, and allows for tighter clearance differences between the ball's outer dimension ($d_B$) and the seat's initial inner dimension ($d_1$) as noted herein.

In summary, the segments 164 of the ramped seat 160 in an initial position are expanded outward from one another (FIG. 6A), define a first contact area for engaging a particularly sized ball B, and move the inner sleeve 130 to the opened position (FIG. 7A) in response to fluid pressure applied against the engaged ball B. Eventually, the segments 164 move from the initial, expanded condition to the subsequent, contracted condition in the inner sleeve 130 when the sleeve 130 is in the opened position. This movement can be primarily in response to application of higher fluid pressure against the engaged ball B during the treatment (e.g., fracturing) operation. The segments 164 in the contracted condition are contracted inward by engagement of the segments' inclined surfaces with the ramp 169. Additionally, the segments 164 being contracted define a contact area engaging the deployed ball B that is greater than the initial contact area used to first engage the ball B and move the inner sleeve 130 open.

As can be seen, the initial condition of the seat 160 provides an internal passage that does not engage smaller balls not intended to open the sliding sleeve 100. Yet, when the intended ball B engages this seat 160 in this initial condition, the seating surface increases as the pressure is applied, the inner sleeve 130 opens, and the segments 164 contract inward. As detailed herein, this increase in seating area or surface allows the seat 160 to be used for passing more balls B along a tubing string and can reduce the chances that the edges of a fixed seat with an internal diameter close to the diameter of the ball B would shear off the outside surface of the ball B when pressure is applied without opening the inner sleeve 130.

Again as previously noted, the sliding of the segments 164 in the bore 135, the contraction of the segments 164 inward, and the pressure applied against the seated ball B together act in concert to wedge the ball B in the seat 160. Thus, as depicted to some extent in FIG. 8B, the segments 164 not only support the lower end of the ball B, but also tend to squeeze or press against the sides of the ball B, which may have initially been able to fit somewhat in the seat 160 while the segments 164 were expanded and may be subsequently squeezed and deformed. This form of wedged support has advantages for both aluminum and composite balls B as noted above by increasing the bearing area on the ball and helping the ball to stay seated and withstand high pressures.

As shown in FIGS. 6A through 7B, the segments 164 of the seat 160 can be initially disposed in the expanded state inside the bore 135 of the inner sleeve 130. As an alternative, the segments 164 can be disposed in an expanded state inside the bore 125 of the housing 120 in an arrangement similar to FIGS. 3 and 4A-4D. All the same, the seat 160 can still contract from the first position with the segments 164 expanded against the bore 125 of the housing 120 to the second position with the segments 164 contracted inside the inner sleeve's bore 135. The spacer ring 162 may, therefore, be omitted or may be moved inside the housing's bore 125.

Figure 9B:
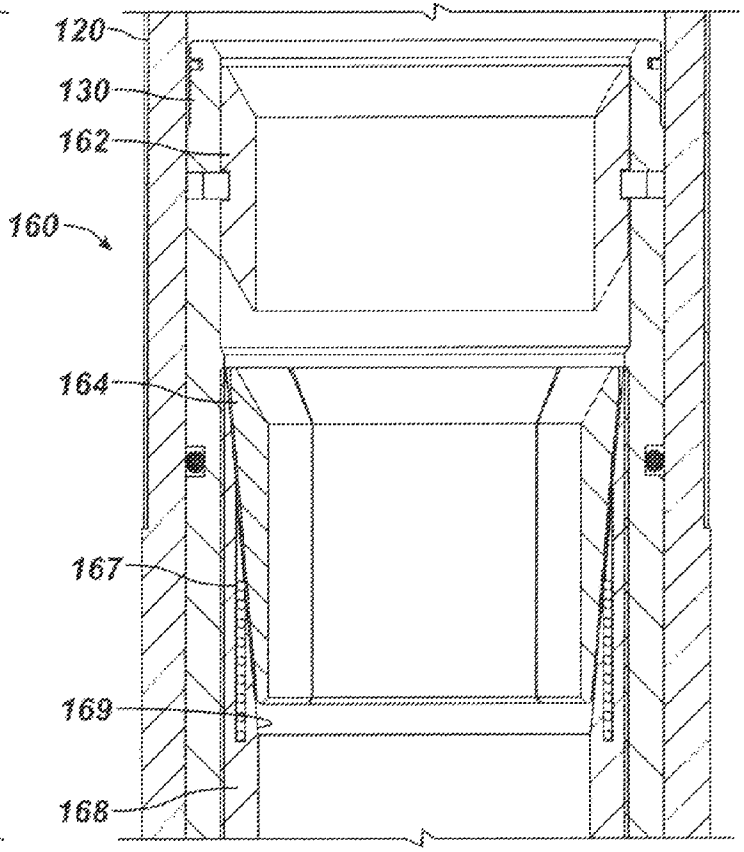
FIG. 9B shows an alternative biasing arrangement for the ramped seat's segments.
Figure 9A:
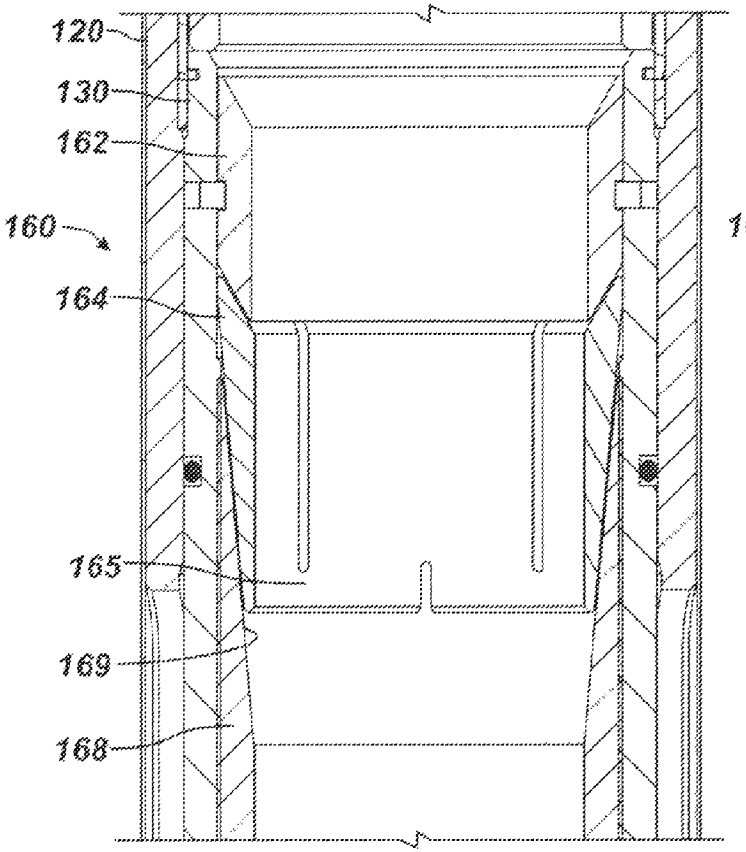
FIG. 9A shows an alternative form of the segments for the ramped seat.

As noted above, the segments 164 can be independent elements. As an alternative, the segments 164 can be connected together at their lower end using interconnected sections 165, as shown in FIG. 9A. Being connected at their lower ends, the segments 164 move as a unit in the sleeve 130. All the same, the segment's unconnected upper ends can expand and contract relative to one another during use.

As indicated above, use of the biasing ring 166 enables the segments 164 to retract back to its retracted position when floating the ball B out of the sliding sleeve 100 of the tubing string. All the same, the segments 164 may be initially held in the retracted condition without a biasing ring 166 and may instead be held with epoxy, adhesive, resin, or other type of packing. Additionally, a biasing element can be used elsewhere to move the segments 164 to their initial position. As shown in FIG. 9B, for example, a biasing element 167 such as a spring is positioned in the ramped sleeve 168. This placement of the biasing element(s) 167 not only helps move the segments 164 to their retracted condition, but also helps move the segments 164 upward in the inner sleeve 130 when floating the ball B, which may have advantages in some implementations.

C. Sliding Sleeve Having Contracting, Dual Segmented Ball Seat

The sliding sleeve 100 illustrated in FIGS. 10A through 11B has a dual segmented seat 170 disposed in the bore 135 of the inner sleeve 130. In FIGS. 12A-12B, the sliding sleeve 100 is shown in closed and opened conditions having another dual segmented seat 170 of a different size.

As before, the sliding sleeve 100 opens with a particularly sized ball B deployed in the sleeve 100 when the deployed ball B engages the seat 170, fluid pressure is applied against the seated ball B, and the inner sleeve 130 shifts open relative to the flow ports 126.

Figure 10A:
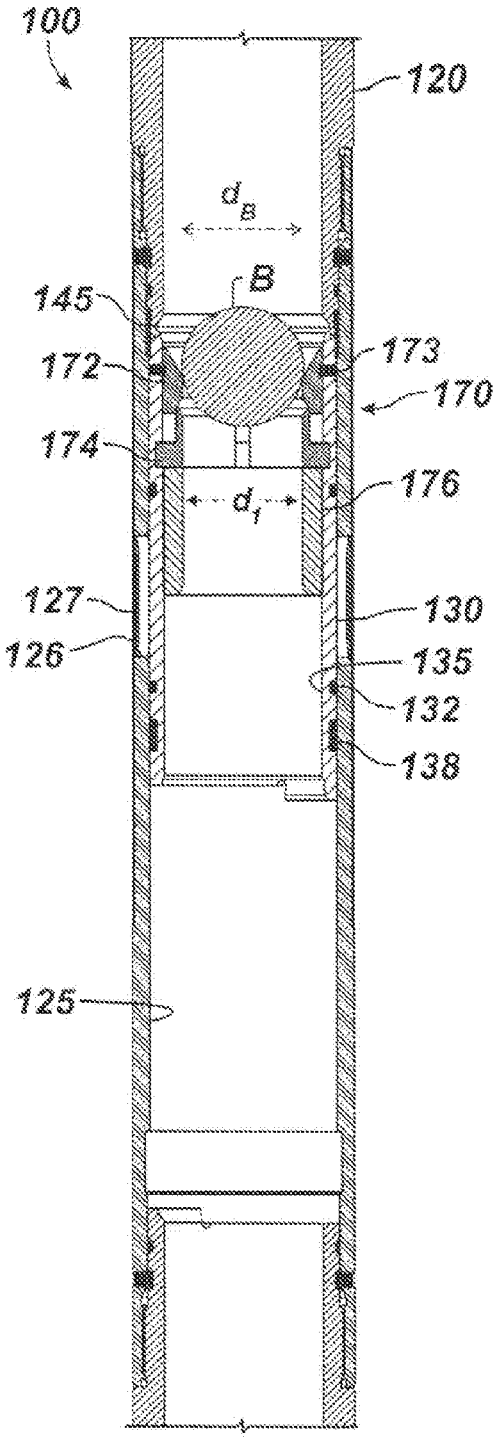
FIG. 10A illustrates a sliding sleeve in a closed condition having a dual segmented seat according to the present disclosure.
Figure 10B:
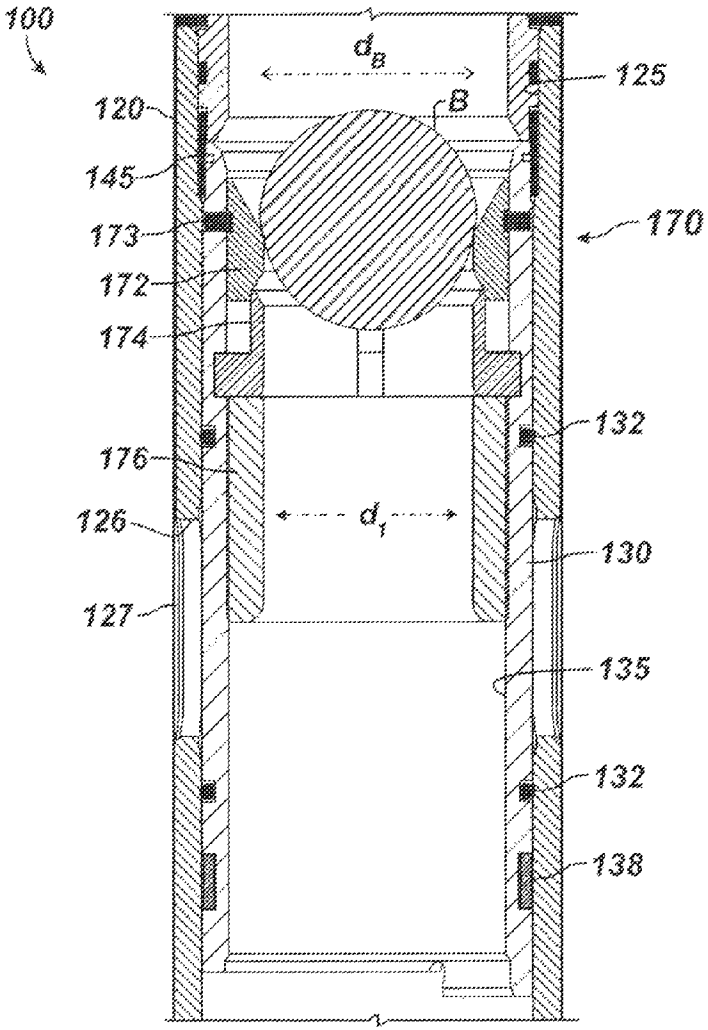
FIG. 10B illustrates the sliding sleeve of FIG. 10A showing the dual segmented seat in detail.

The seat 170 includes a sliding or landing ring 172 and a compressible ring, which can have segments 174. When deployed, the seat 170 has an initial, retracted condition (FIGS. 10A-10B). In this condition, the sliding ring 172 is fixed by one or more shear pins 173 or other temporary element in the bore 135 and defines an inner passage sized to pass balls B of a smaller diameter. The segments 174 disposed in the inner sleeve's bore 135 have a retracted condition so that the segments 174 define an inner dimension the same as or larger than the inner dimension ($d_1$) of the sliding ring 172. Although retracted, each segment 174 defines a space between a portion of the segment 174 and the inner sleeve's bore 135. To protect the segments 174 from debris and the like, the spaces behind and between the segments 174 can be packed with a filler material, such as grease, epoxy, resin, or the like.

The segments 174 can be held retracted in a number of ways. For example, the segments 174 may be free moving in the inner sleeve 130 but may be temporarily held retracted using epoxy, resin, etc., or other filler material. Alternatively, interconnecting portions of the segments 174 disposed between them can hold the segments 174 outward from one another, and these interconnecting portions can be broken once the segments 174 are moved inward toward one another with a certain force. Further, one or more biasing elements, such as a split ring (not shown) can bias the segments 174 outward from one another similar to other arrangements disclosed herein.

When the appropriately sized ball B is dropped, the ball B engages against the sliding ring 172 in its initial position. The ring 172 supports the deployed ball B with an initial contact dimension ($d_1$). When fluid pressure is applied against the seated ball B, the inner sleeve 130 breaks free of the temporary attachment 145 and moves toward the opened position in the sliding sleeve 100 (FIG. 11A).

Figure 11A:
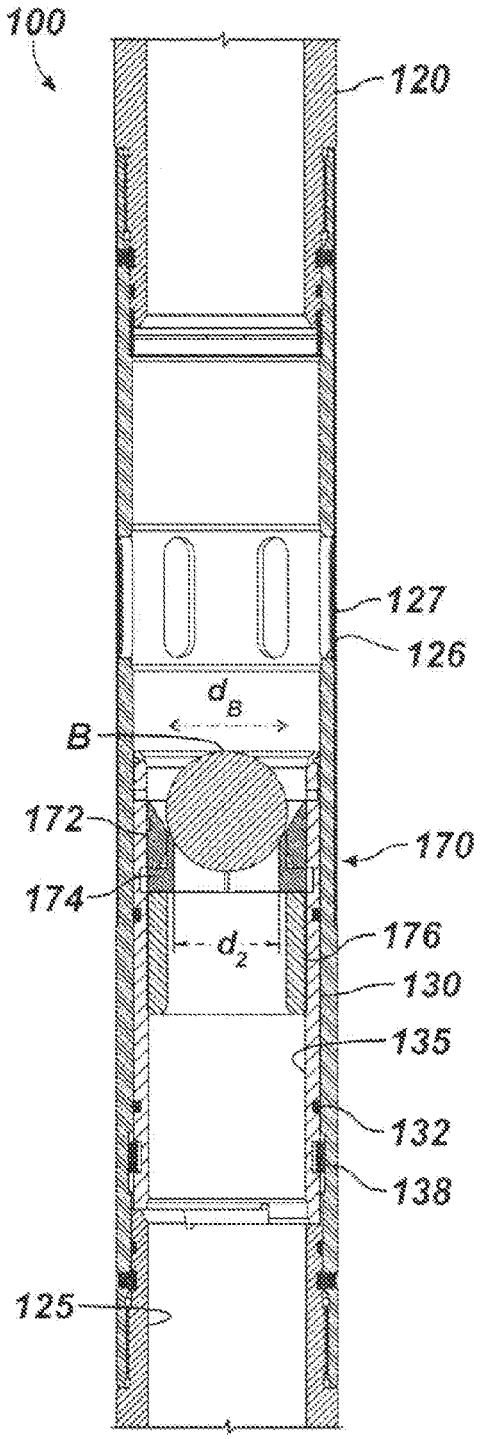
FIG. 11A illustrates the sliding sleeve of FIG. 10A in an opened condition.
Figure 11B:
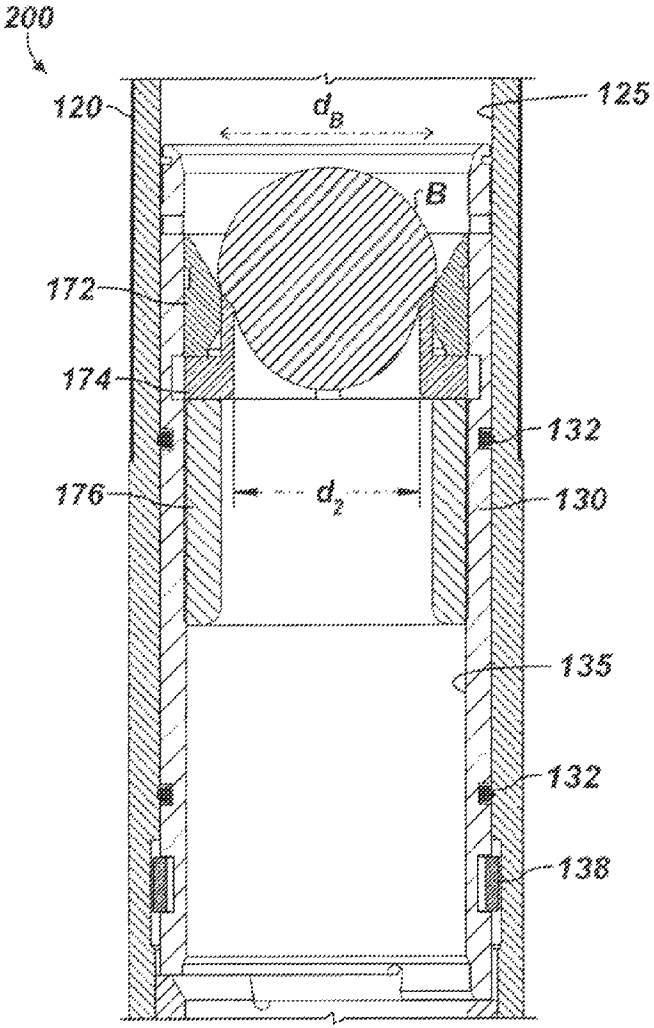
FIG. 11B illustrates the sliding sleeve of FIG. 11A showing the dual segmented seat in detail.
Figure 12B:
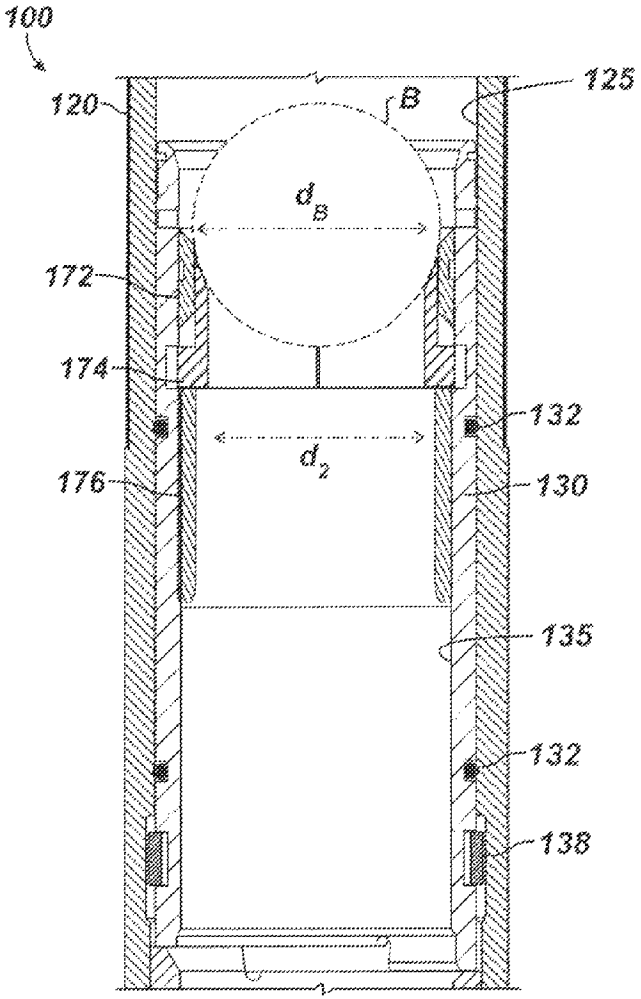
FIGS. 12A-12B illustrate a sliding sleeve in closed and opened conditions showing another embodiment of a dual segmented seat in detail.
Figure 12A:
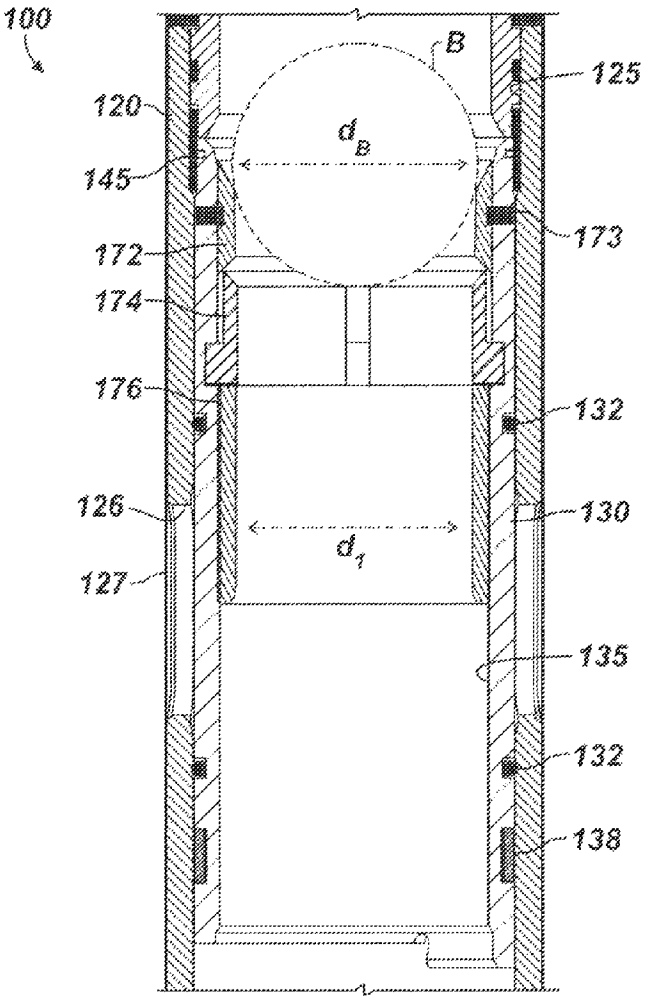

With the inner sleeve 130 open, the applied pressure acts primarily against the seated ball B and eventually breaks the shear pins 173 that hold the ring 172, allowing the sliding ring 172 to slide in the inner sleeve's bore 135 (FIGS. 11A-11B). This movement of the sliding ring 172 may occur when increased fluid pressure is pumped downhole to the sliding sleeve 100 during a fracturing or other treatment operation.

As the sliding ring 172 moves, it fits in the space between the segments 174 and the sleeve's bore 135 and moves the segments 174 inward toward one another. As shown in FIGS. 10A-10B, for example, ends of the segments 174 in the retracted condition are in contact with the ring 172 in its initial position. The ring 172 defines a ramp on its lower edge that engages the ends of the segments 174 when the ring 172 moves from the first position to the second position. Thus, as the ring 172 slides, the lower ramped edge of the ring 172 fits behind the segments 174, which then push inward toward one another.

Once the segments 174 contract inward, the sealing surface of the seat 170 for engaging the seated ball B increases. In particular, the edge of the ring 172 defines the contact dimension ($d_1$) for initially engaging the deployed ball B (FIGS. 10A-10B). This internal contact dimension ($d_1$) is narrower to some extent than an outer dimension ($d_B$) of the deployed ball B in much the same manner discussed in other embodiments herein, although any suitable dimensions can be used.

Once the segments 174 are moved inward to support the engaged ball B (FIGS. 11A-11B), however, the ends of the segments 174 move to support the engaged ball B with a contact dimension ($d_2$) narrower than the initial contact dimension ($d_2$). The reduced contact dimension ($d_2$) helps support higher fluid pressure during treatment (e.g., fracturing) operations. The reduced contact dimension ($d_2$) of the segments 174 contracted inward can be approximately 0.345-in. narrower than the ring 172's dimension ($d_1$).

Further, the subsequent contact dimension ($d_2$) of the segments 174 as shown in FIGS. 11A-11B encompasses more surface area than provided by the edge of the ring 172 initially used to support the ball while opening the inner sleeve 130. Finally, contraction of the segments 174 can act in concert with the pressure applied against the deployed ball B to create the wedged seating of particular advantage noted herein, which is shown to some extent in FIG. 11B.

As shown, a support ring 176 can disposed inside the inner sleeve's bore 135 to support lower ends of the segments 174. This support ring 176 provides at least a portion of a shoulder to support the segments 174. Another portion of the inner sleeve 130 can have a shoulder portion defined therein to support the segments 174. Alternatively, the inner sleeve 130 may lack such a separate support ring 176, and a shoulder in the inner sleeve 130 can be used alone to support the segments 174.

D. Sliding Sleeve Having Contracting, Ringed Ball Seat

Figure 13B:
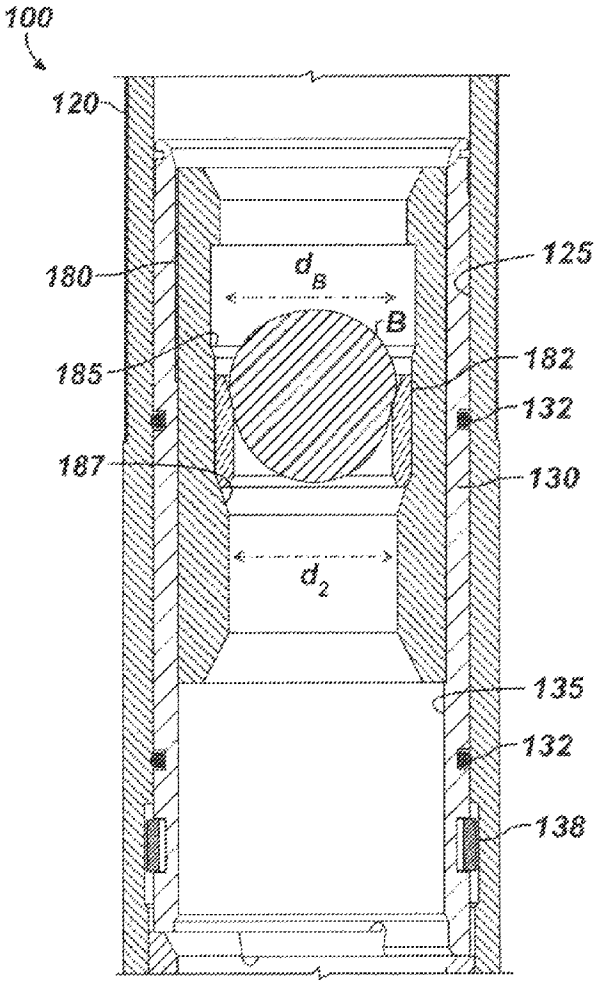
FIGS. 13A-13B illustrate a sliding sleeve in closed and opened conditions showing a ringed seat in detail.
Figure 13A:
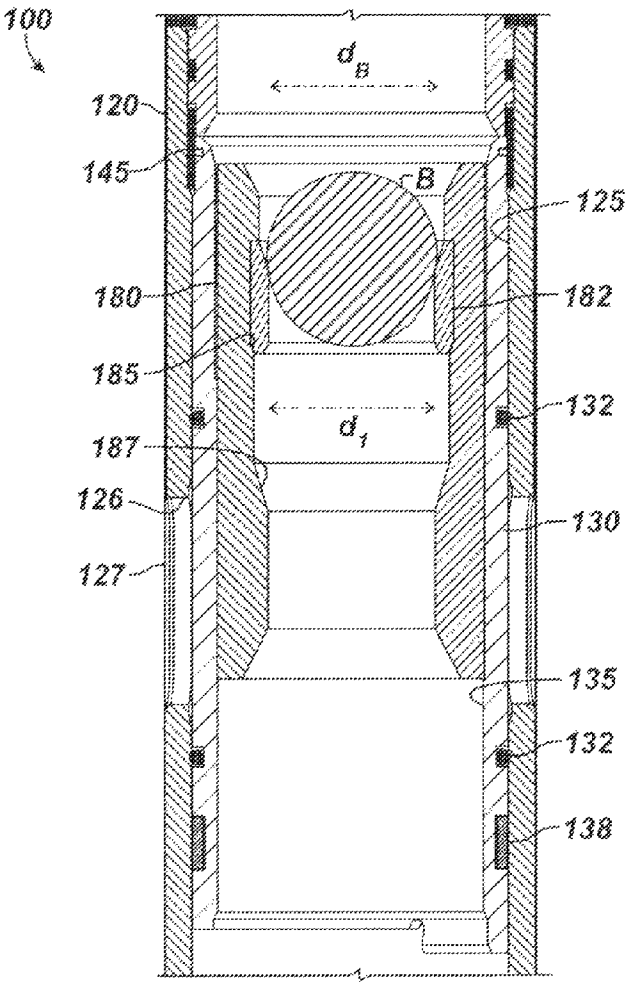

The sliding sleeve 100 illustrated in FIGS. 13A-13B has a ringed seat having an insert 180 and a biased ring 182. The insert 180 can be a separate component fixed in the inner sleeve 130 of the sliding sleeve 100 and has an inner passage with two different sized passages, slots, or transitions. One slot 185 has a greater inner diameter than the other slot 187. The change in the internal dimension between the slots 185 and 187 can be gradual or abrupt. Having the insert 180 disposed in the inner sleeve 130 facilitates assembly, but the inner sleeve 130 in other arrangements may include the features of the insert 180 instead.

Figure 13C:
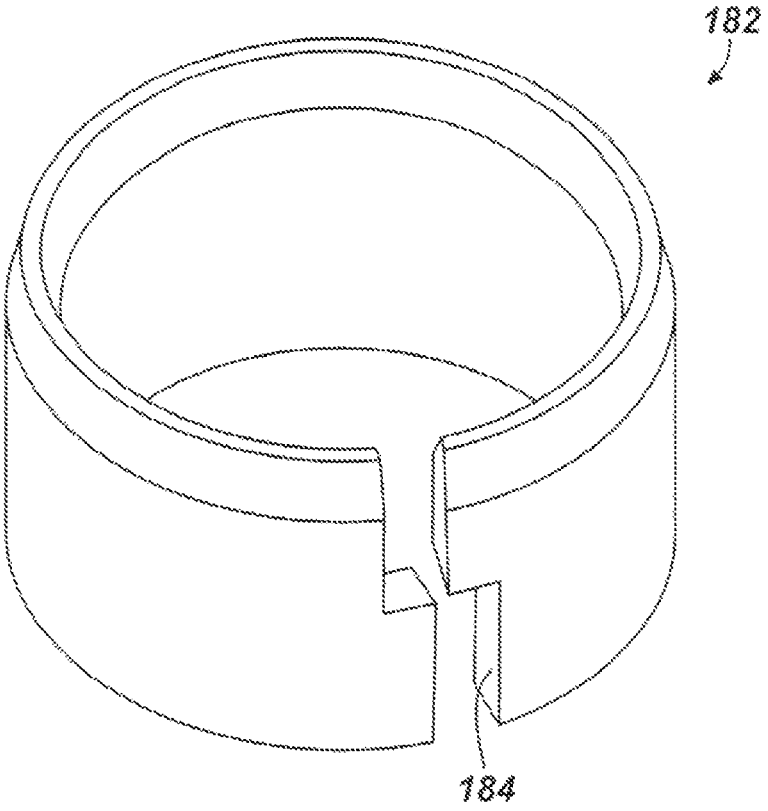
FIG. 13C illustrates an isolated view of a split ring used for the ringed seat of FIGS. 13A-13B.

The biased ring 182 can comprise any of a number of biased rings. As shown in FIG. 13C, for example, the biased ring 182 can be a split ring or C-ring. The split 184 in the ring 182 can be stepped to prevent twisting of the ring 182 during movement.

As shown in FIG. 13A, the biased ring 182 disposes in an initial position in the upper slot 185 of the insert 180. In this position, the biased ring 182 has an expanded state so the seat 180 can pass balls of a smaller diameter through the sleeve 100. When the appropriately sized ball B is dropped, the ball B engages against the biased ring 182 in the expanded state. As can be seen, the engagement encompasses a contact area governed mainly by an edge of the biased ring 182. Also, because the biased ring 182 is expanded, the engagement defines a contact dimension ($d_1$) that is close to the outer dimension ($d_B$) of the engaged ball B. In fact, the biased ring 182 in the expanded state can have an inner dimension ($d_1$) for engaging the ball B that is narrower than the outer dimension ($d_B$) of the ball B in much the same manner discussed in other embodiments herein, although any suitable dimensions can be used.

Applied pressure against the seated ball B eventually shifts the biased ring 182 in the insert 180 to the narrower slot 187 (FIG. 12B). As it shifts past the transition, the biased ring 182 contracts inward to a contracted state. In this contracted state, the biased ring 182 engages the ball B with an increased contact area greater than the initial contact area and with a narrower contact dimension ($d_2$), which both provide better support of the ball B. Fluid pressure then applied against the ball B engaged in the ring 182 abutting the engagement point of the insert 180, moves the inner sleeve 130 open.

By using the biased ring 182, the number of increments between the ball diameters and the seat inner diameters can be increased. For example, the seat 180 can provide up to 50 increments for composite balls B due to the initial expanded state and subsequent contracted state of the biased ring 182 used to initially engage the ball B and then open the sleeve 130.

Finally, the ring seat can benefit from the wedging engagement described herein, which is depicted to some extent in FIG. 13B. For example, as the ring 182 transitions from the initial state to the contracted state, it compress against sides of the ball, which is being forced into the engaged in the ring 182 as well as moving the seat 180. Any subsequent squeezing and deformation of the ball B creates the form of wedged support that has advantages for both aluminum and composite balls B as noted above by increasing the bearing area on the ball and helping the ball to stay seated and withstand high pressures.

E. Sliding Sleeve Having Inverting Ball Seat

The sliding sleeve 100 in FIGS. 14A-14D has an inverting seat 190. As before, the sliding sleeve 100 opens with a particularly sized ball B deployed in the sleeve 100 when the deployed ball B engages the inverting seat 160, fluid pressure is applied against the seated ball B, and the inner sleeve 130 shifts open relative to the flow ports 126.

The inverting seat 190 includes an insert 192 fixed in the inner sleeve 130 and includes a beveled or frusto-conical ring 194. As shown, the beveled ring 194 can be a continuous ring fixed around the inside of the insert 192, or the ring 194 may have one or more slits or slots around its inside perimeter. The beveled ring 194 can comprise any of a number of materials, such as metal, thermoplastic, elastomer, or a combination of these.

Figure 14E:
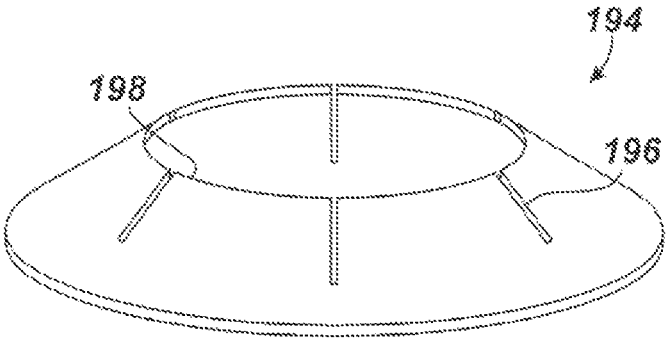
FIG. 14E shows an alternative form of beveled ring.
Figures 14A, 14B, 14C:
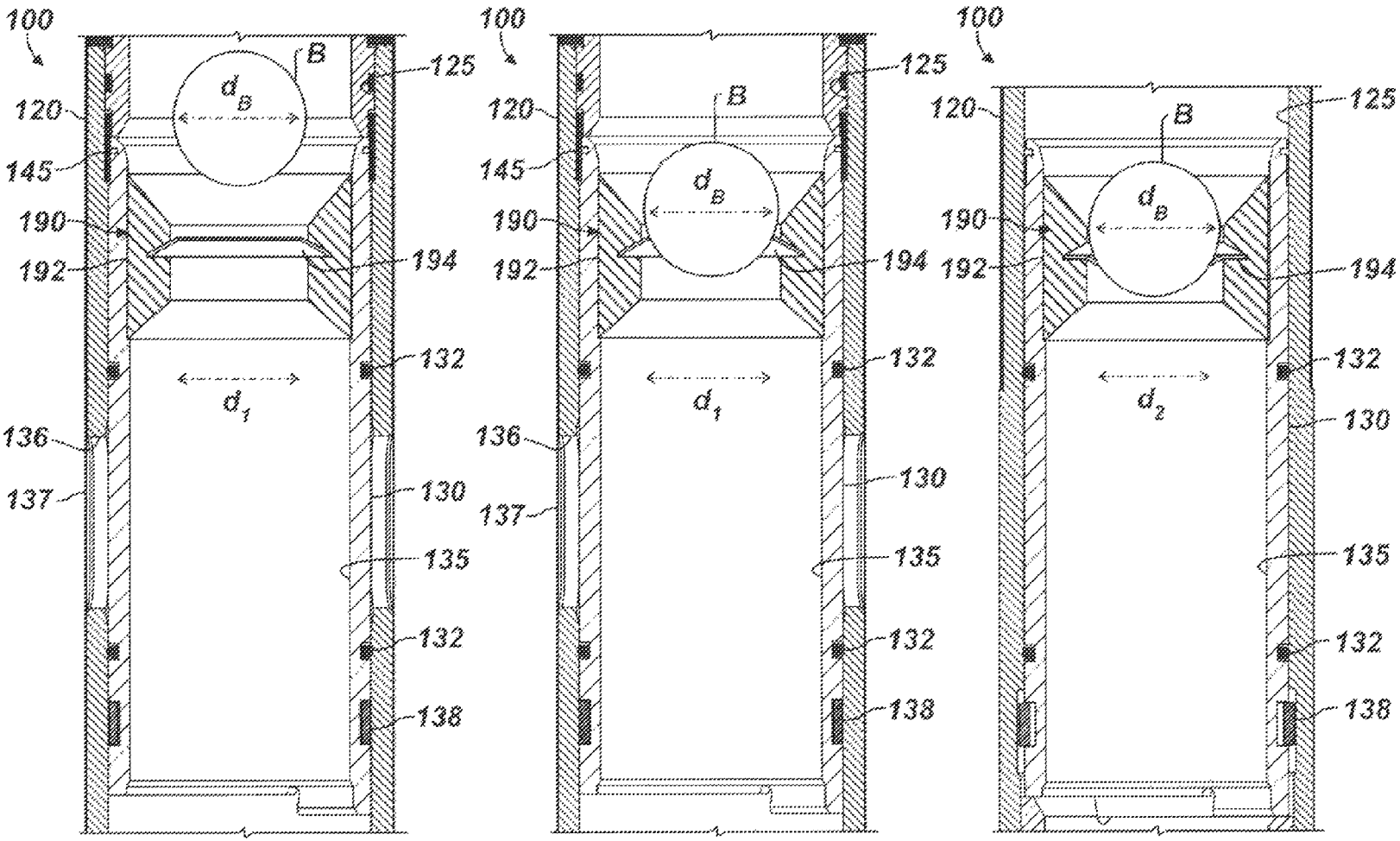
FIGS. 14A-14C illustrate a sliding sleeve showing an inverting seat in detail during an opening procedure.
Figure 14D:
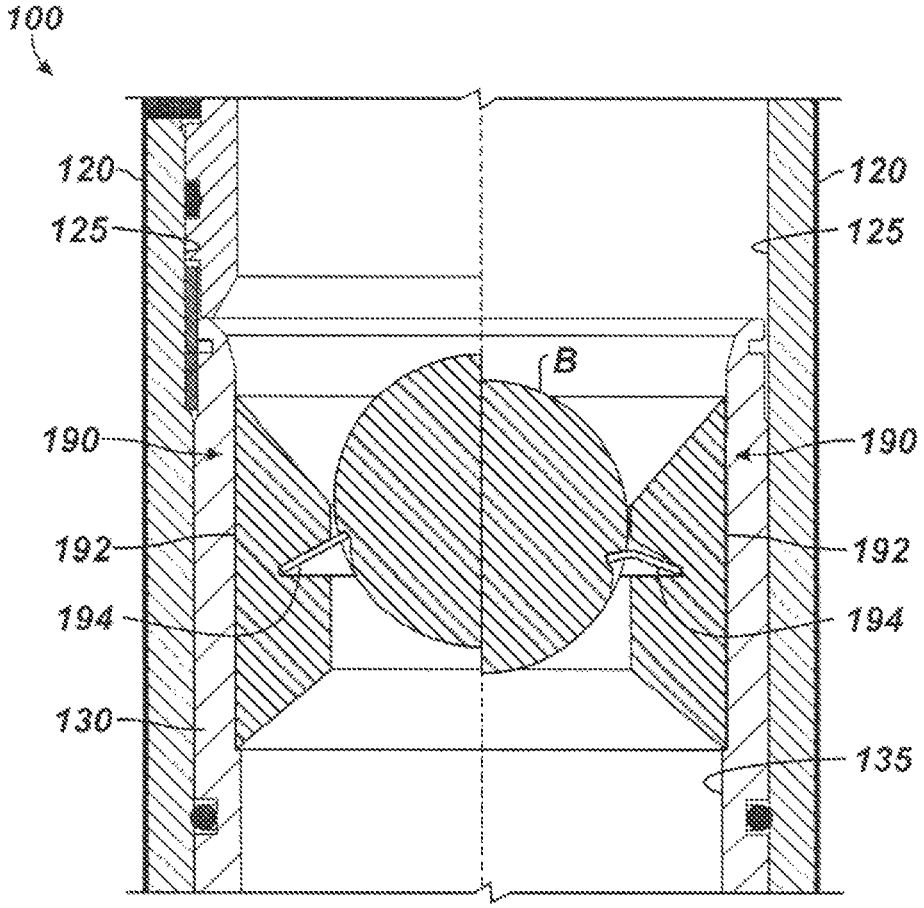
FIG. 14D illustrates a detail of the inverting seat engaging a dropped ball.

Initially, as shown in FIG. 14A, the beveled ring 194 extends uphole and forms a smaller inner passage than the insert 192. In particular, the beveled ring 194 being frusto-conical has a top open end formed by an inner perimeter and has a base end formed by an outer perimeter. In the initial state shown in FIG. 14A, the top open end is disposed more toward the proximal end of the inner sleeve 130 than the base end. The top end of the ring 194 in the initial state can have an inner dimension ($d_1$) for engaging the ball B that is narrower to some extent than the outer dimension ($d_B$) of the ball B in much the same manner discussed in other embodiments herein, although any suitable dimensions can be used.

Rather than a continuous ring as shown, the beveled ring 194 can have a series of tongues disposed around the inner sleeve's bore 135. For example, FIG. 14E shows a beveled ring 194 having one or more slits or slots 196 forming tongues 198. Each of the tongues 198 can have a free end forming the top open end within the sleeve's bore 135, and each of the tongues can have a fixed end attached to the insert 192.

In its initial condition (FIG. 14A), the seat 190 allows balls of a smaller size to pass therethrough to actuate other sliding sleeves on a tubing string. When an appropriately sized ball B is dropped to the sliding sleeve 100, the ball B engages against the upward extending end of the beveled ring 194. Applied pressure against the ball B in the seat 190 eventually breaks the attachment 145 of the inner sleeve 130 to the housing 120, and the pressure applied against the ball B in the seat 190 causes the inner sleeve 130 to slide open (FIG. 14B).

Once the inner sleeve 130 moves open, applied pressure against the seated ball B during the fracturing or other treatment operation presses primarily against the beveled ring 194, causing it to invert or deform downward. As shown in FIG. 14C, the beveled ring 194 deforms at least partially from the initial state to an inverted state in the opened inner sleeve 130. When the beveled ring 194 is continuous as shown, the ring 194 deforms with the top open end bent inward toward the bottom open end. When the beveled ring 194 uses tongues, the tongues are deformed with the free ends bend in toward the fixed ends.

Either way, the deformation or inversion of the beveled ring 194 creates more surface area on the seat 190 to engage the seated ball B. In particular, the ball B initially engages a contact area of the beveled ring 194 in its initial state defined by the open top edge. However, the seat 190 in the inverted state engages the deployed ball B with more contact area defined by portions of the topside of the ring 194. Moreover, the seat 190 in the inverted state creates a smaller inner dimension ($d_2$) than the seat 190 in the initial state. As by one example, this smaller inner dimension ($d_2$) can be approximately 3/10-in. narrower than the original inner dimension ($d_1$), although any suitable dimension can be used.

Finally, the inversion of the beveled ring 194 produces the wedging engagement, which is advantageous as noted herein. In fact, the top open end of the ring 194 may tend to bite or embed into the ball B when initially engaged against the ball and pressure is applied. This may further enhance the wedging engagement, which is depicted to some extent in FIG. 14D and which has advantages as noted herein.

F. Sliding Sleeve Having Deformable Ball Seat

Figure 15A:
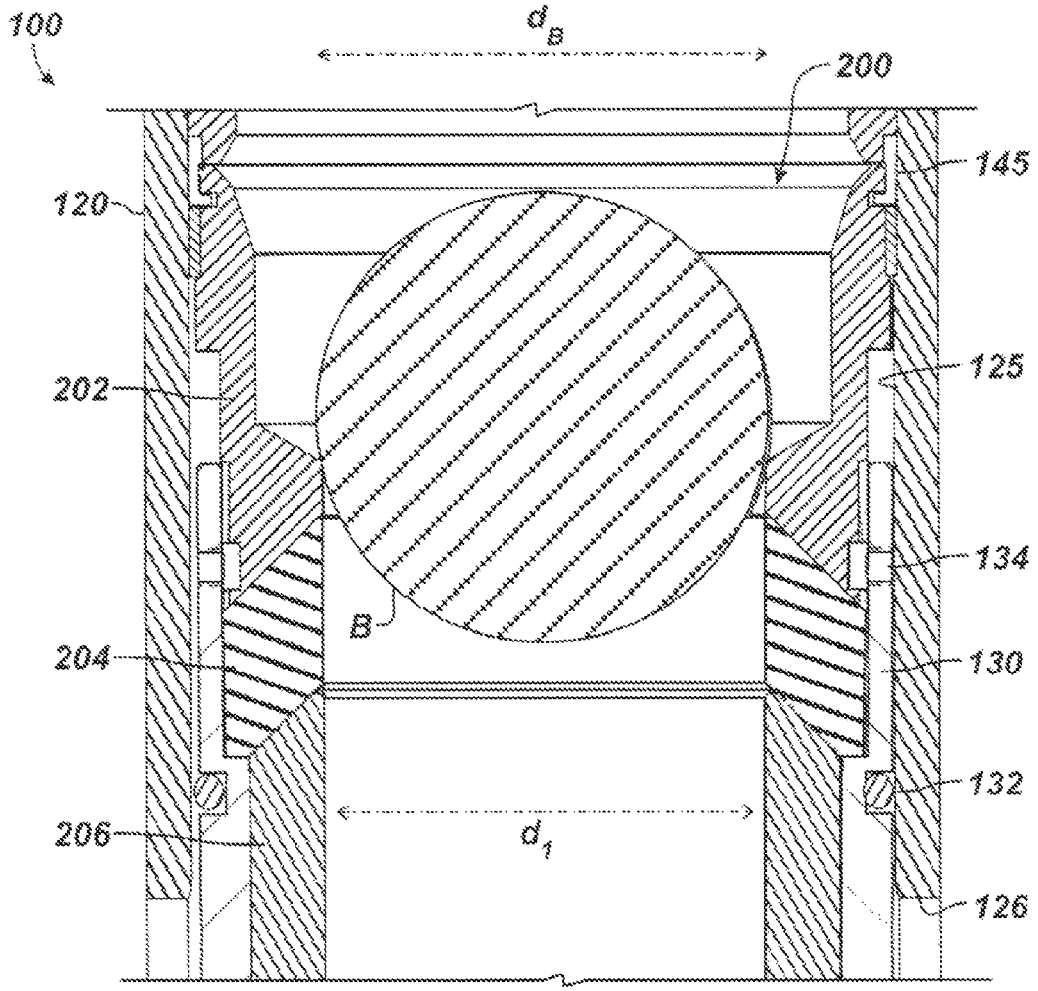
FIGS. 15A-15B illustrate a sliding sleeve in closed and opened conditions showing a deformable seat in detail.
Figure 15B:
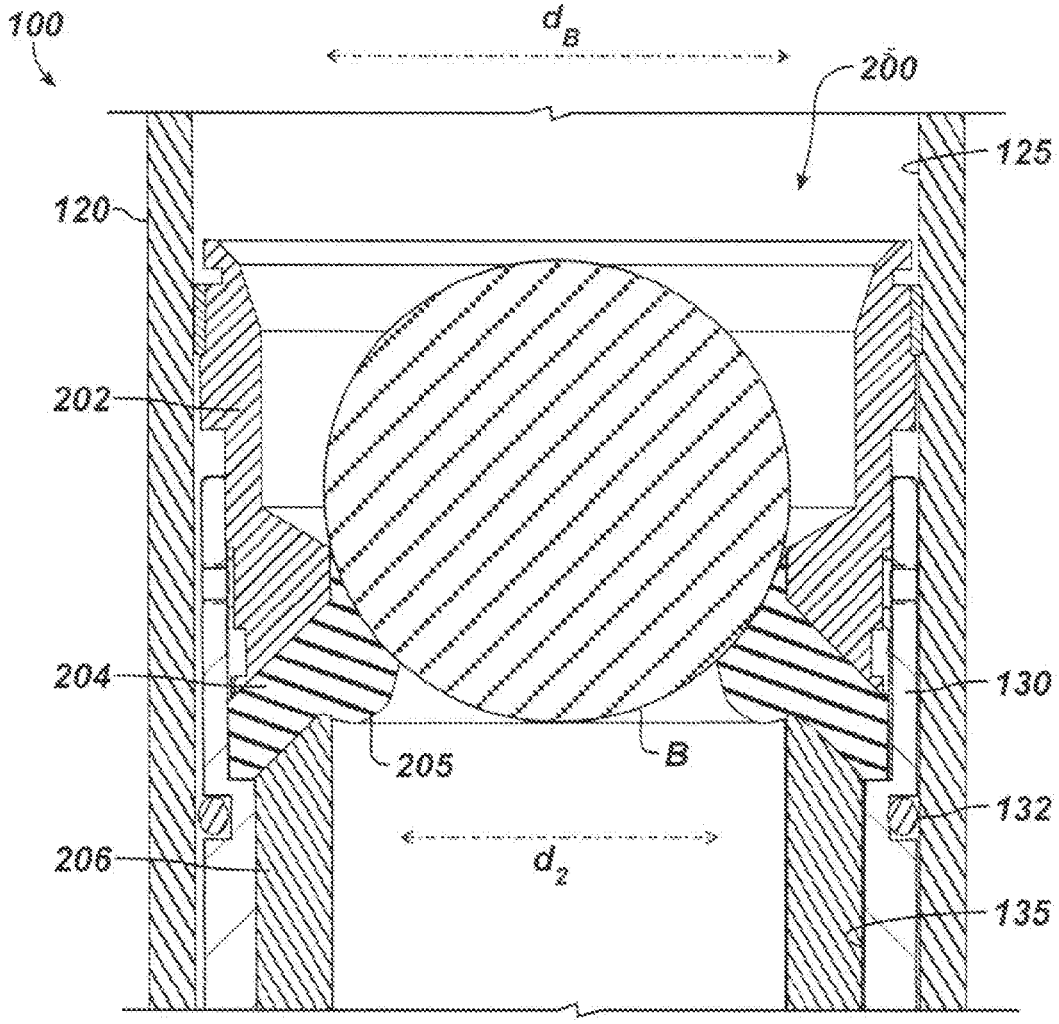

The sliding sleeve 100 shown in FIGS. 15A-15B in closed and opened conditions has a deformable seat 200. As before, the sliding sleeve 100 has many of the same components (i.e., housing 120, inner sleeve 130, etc.) as in other embodiments and opens when a corresponding ball B of a particular size is deployed in the sleeve 100.

The deformable seat 200 includes a movable ring 202, a deformable ring 204, and a fixed ring or insert 206. As shown in FIG. 15A, shear pins or other temporary attachments 134 hold the movable ring 202 on the inner sleeve 130, and a temporary retainer 145 holds the movable ring 202 and, by connection, the inner sleeve 130 in the closed condition.

The fixed ring 206 is fixed inside the bore 135 of the inner sleeve 130 and can thread inside the sleeve's bore 135, for example, or affix therein in any other suitable manner. As can be seen, the fixed ring 206 forms at least part of a shoulder for supporting the deformable ring 204. The inner sleeve 130 can also form part of this shoulder. As an alternative, the sleeve 130 can form the entire shoulder for supporting the deformable ring 204 so that use of the fixed ring 206 may not be necessary.

The deformable ring 204 fits between the movable and fixed rings 202 and 206. At its name implies, the deformable ring 204 is composed of a deformable material.

The seat 200 allows balls of a smaller size to pass therethrough so they can be used to open sliding sleeves further down the tubing string. Eventually, the appropriately sized ball B is dropped and reaches the sliding sleeve 100. The dropped ball B then seats in the movable ring 202, and an edge of the movable ring 202 defines an initial contact area with the ball B. The movable ring 202 defines an inner dimension ($d_1$) that is narrower than the outer dimension ($d_B$) of the ball B. In general, the requirement for the difference between the ball's outer dimension ($d_B$) and the seat's inner dimension ($d_1$) is for the ball to be small enough to pass through any seats above, but large enough to create an interference fit with the currently engaged seat before the seat deforms. Although any suitable dimensions can be used, the difference in dimensions can be the same as discussed in other embodiments herein.

Initial pressure applied down the tubing string against the seated ball B in the movable ring 202 presses against the movable ring 202, eventually breaking the temporary restraint 145 of the inner sleeve 130 due to the lower shear force of the restraint 145 compared to the shear pins 134. The pressure acting against the movable ring 202 and ball B then moves in the inner sleeve 130 downward, opening the sliding sleeve 100.

Once the sliding sleeve 100 is open, the inner sleeve 130 shoulders in the sleeve's bore 125 so that any fluid pressure applied downhole can act against the ball B and movable ring 202. With the sleeve 100 communicating with the surrounding borehole, subsequent fluid pressure, such as a fracturing pressure, may be applied against the ball B in the movable ring 202. With the increased pressure, the movable ring 202 breaks the one or more shear pins 132, allowing the movable ring 202 to move down in the inner sleeve 130 against the deformable ring 204.

Compressed between the movable ring 202 and the fixed ring 206, the deformable ring 204 deforms as the movable ring 202 is pressed toward the shoulder and fixed ring 206. When it deforms, the deformable ring 204 expands inward in the sleeve 130 as a bulge or deformation 205 and engages against the deployed ball B (FIG. 15B). This bulge 205 increases the engagement of the seat 200 with the ball B creates a contact area between the seat and ball B that is greater than the initial contact area between just the movable ring 202 and the ball B and encompasses more surface area than just the edge of the movable ring 202 used to open the sleeve 130. Likewise, the engagement of the deformable ring's bulge 205 with the ball B produces a narrower dimension ($d_2$) for supporting the ball B than provided by the movable ring's edge alone so the ball B can be further supported at higher subsequent pressures during a fracturing or other operation. As an example, the narrower dimension ($d_2$) of the bulge 205 can be approximately about $3/10^{th}$ of an inch narrower than the outer dimension ($d_B$) of the ball B, although any suitable difference in dimensions can be used for a particular implementation, the pressures involved, and the desired amount of support.

Figure 16A:
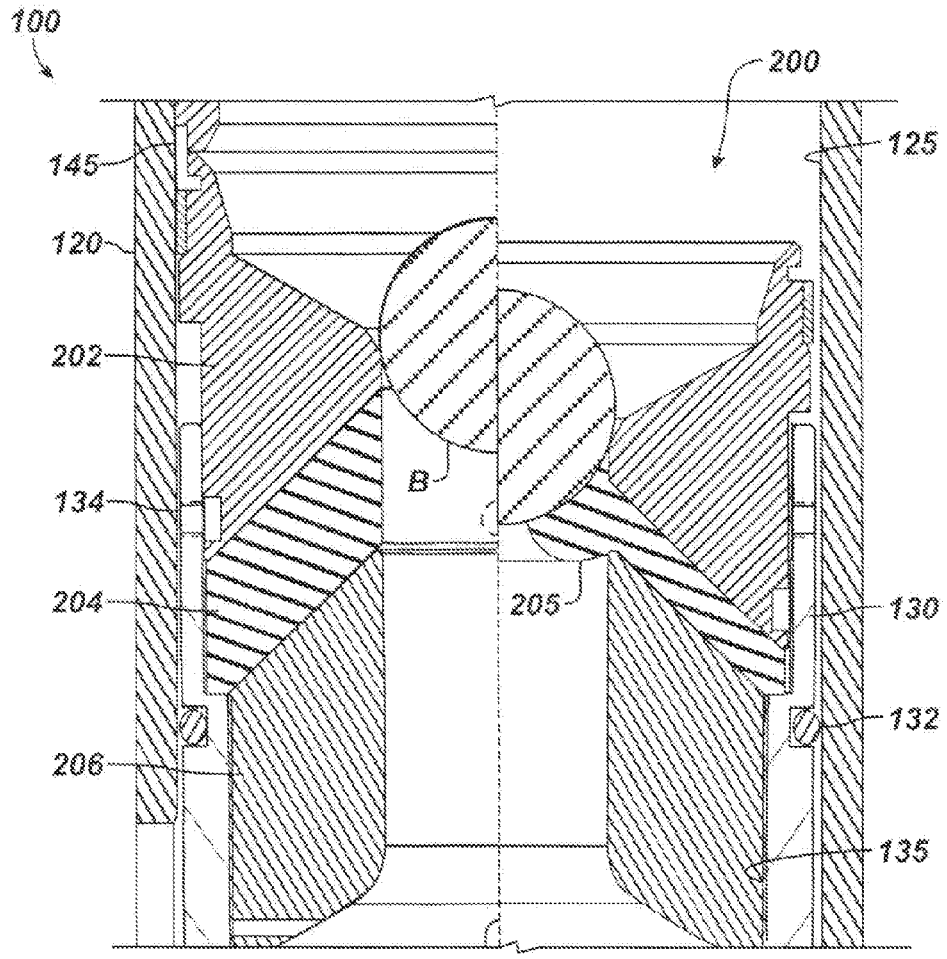
FIGS. 16A-16C illustrate the sliding sleeve in closed and opened conditions showing other embodiments of a deformable seat in detail.
Figure 16B:
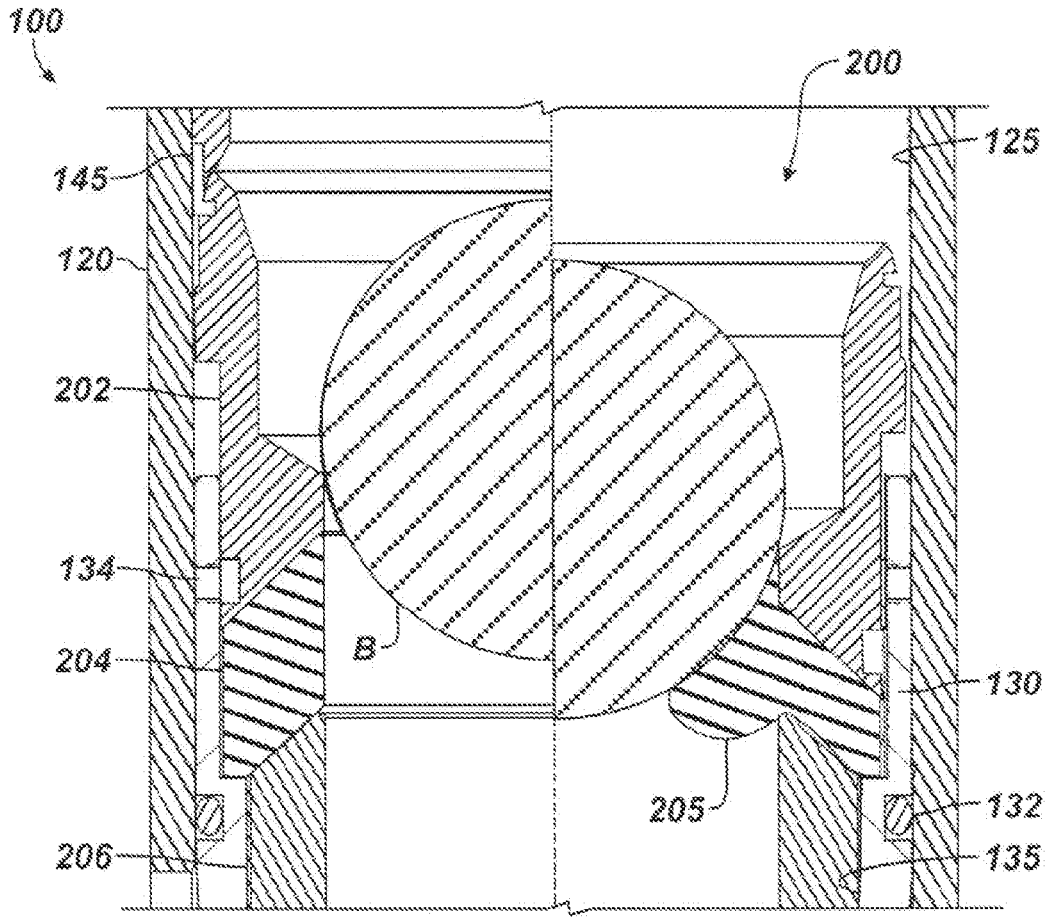
Figure 16C:
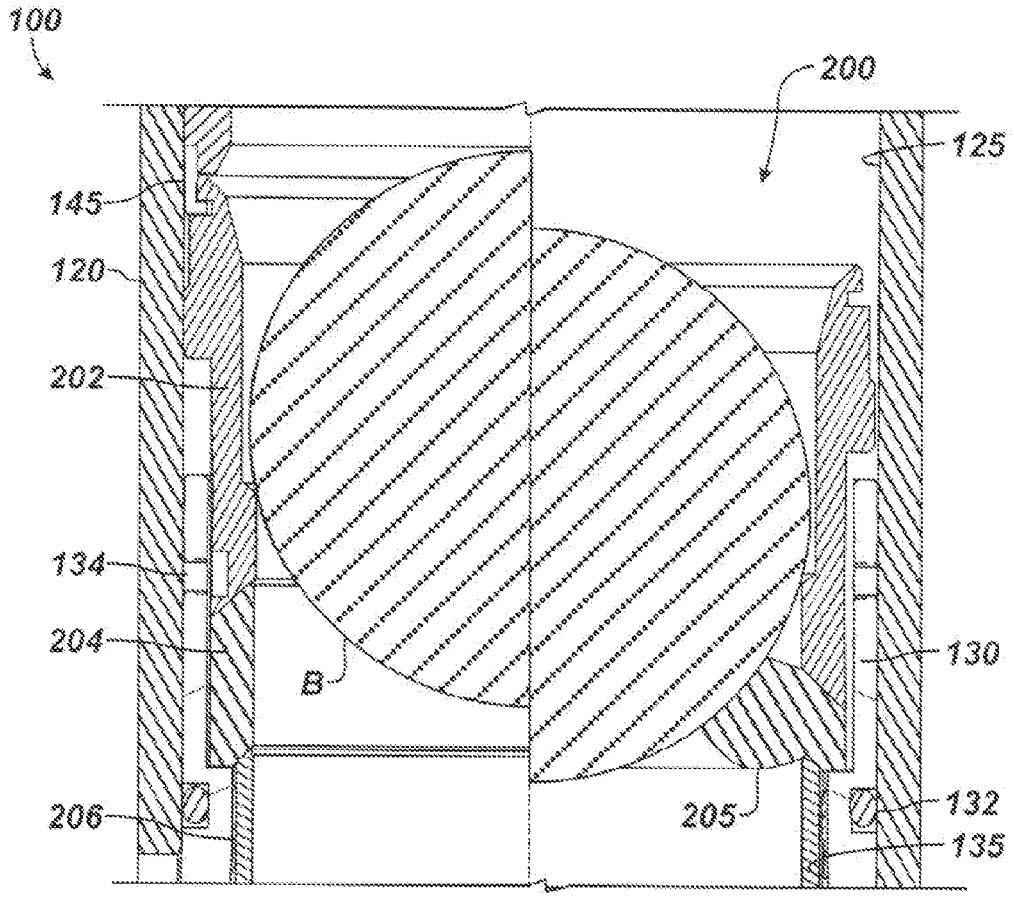

Other embodiments of the deformable seat 200 are illustrated in FIGS. 16A-16C, showing different sized seats 200 to support different ball sizes. In general, the deformable ring 204 can be composed of a suitable material, including, but not limited to, an elastomer, a hard durometer rubber, a thermoplastic such as TORLON®, a soft metal, cast iron, an elastically deformable material, a plastically deformable material, PEEK, or a combination of such materials, such as discussed previously. The particular material used and durability of the material used for the deformable ring 204 can be configured for a given implementation and expected pressures involved.

Moreover, the selected durability can be coordinated with expected pressures to be used downhole during an operation, such as a fracturing operation, and the configured breaking point of the shear pins 134 or other temporary attachments used in the sliding sleeve 100. Additionally, the different sized seats 200 can use different materials for the deformable ring 204 and can be configured to produce a desired bulge 205 under the circumstances expected. For example, a seat 200 with a smaller inner dimension for a smaller ball B may have a softer material than used for larger balls so that hardness of the deformable ring 204 can be considered inversely proportional to the ball and seat size. The particular ratio of hardness to ball and seat size can be configured for a particular implementation, the pressures involved, and the desired amount of support.

Although the movable ring 202 is shown attached to the temporary retainer 145 temporarily holding the inner sleeve 130 in the closed position, this is not strictly necessary. Instead, the retaining element 145 can affix directly to an end of the inner sleeve 130, and the movable ring 202 can be disposed more fully inside the bore 135 of the inner sleeve 130 and held by shear pins. Yet, to prevent over extrusion of the deformable ring 204, a shoulder can be defined in the bore 135 of the inner sleeve 130 to inhibit movement of the movable ring 202 in a manner comparable to the end of the sleeve 130 engaging the downward-facing shoulder of the movable ring 202 in the embodiments depicted in FIGS. 15A through 16C.

Additionally, the fixed ring 206 is shown as a separate component of the seat 200, but this is not strictly necessary. In fact, the inner bore 135 of the inner sleeve 130 can define an integral shoulder and inner dimension comparable to the fixed ring 206, making the fixed ring 206 unnecessary. All the same, the fixed ring 206 facilitates assembly of the seat 200.

Once the seat 200 is opened and the movable ring 202 freed, the increased surface area of the seat 200 from the deformable ring 204 helps support the ball B on the seat 200 when increased pressure from a fracturing operation is applied against the seated ball B as fracturing treatment is diverted out the open ports 126. The bulge or deformation 205 of the sandwiched ring 204 also produces a narrower internal dimension ($d_2$) to support the seated ball B. In the end, the bulge or deformation 205 of the sandwiched ring 204 can further seal the seating of the ball B in the seat 200, although this need not be the primary purpose. Overall, the deformed ring 204 helps produce the wedging engagement of the ball B in the seat 200, which provide the advantages noted herein for aluminum and composite balls.

The foregoing description of preferred and other embodiments is not intended to limit or restrict the scope or applicability of the inventive concepts conceived of by the Applicants. Although components of the seats may be shown and described as "rings," each of these components need not necessarily be completely circular or continuous, as other shapes and segmentation may be used. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter. Accordingly, features and materials disclosed with reference to one embodiment herein can be used with features and materials disclosed with reference to any other embodiment.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A sliding sleeve opening with a deployed plug, the sleeve comprising:

a housing defining a first bore and defining a flow port communicating the first bore outside the housing;

an inner sleeve defining a second bore and being movable axially from a closed position to an opened position inside the first bore relative to the flow port; and a seat disposed in the second bore of the inner sleeve, the seat comprising— a landing ring disposed in the second bore in a first axial position and having a first contact dimension, and a compressible ring disposed in the second bore and defining a space between an upward extending portion of the compressible ring and the second bore, the landing ring in the first axial position engaging the deployed plug with the first contact dimension and moving the inner sleeve to the opened position in response to fluid pressure applied against the engaged plug, the landing ring moving to a second axial position fitting in the space, between the upward extending portion of the compressible ring and the second bore, and contracting the upward extending portion of the compressible ring inward, the upward extending portion of the compressible ring contracted inward to the second contact dimension narrower than the first contact dimension wedging against the engaged plug.

2. The sleeve of claim 1, wherein the landing ring in the first axial position moves the inner sleeve axially to the opened position in response to an initial portion of the fluid pressure applied against the engaged plug.

3. The sleeve of claim 2, wherein the landing ring moves axially from the first axial position to the second axial position in the inner sleeve in response to a subsequent portion of fluid pressure applied against the engaged plug.

4. The sleeve of claim 3, wherein the initial portion of the fluid pressure is less than the subsequent portion of the fluid pressure.

5. The sleeve of claim 4, wherein the subsequent portion of the fluid pressure comprises a fracturing operation pressure.

6. The sleeve of claim 1, wherein the landing ring in the first axial position supports the deployed plug with the first contact dimension, and wherein the compressible ring contracted inward supports the engaged plug with the second contact dimension narrower than the first contact dimension.

7. The sleeve of claim 1, wherein the compressible ring comprises a plurality of segments disposed in the second bore, each of the segments defining the space between the upward extending portion of the segment and the second bore.

8. The sleeve of claim 7, wherein the landing ring in the second axial position fits in the space between the upward extending portion of the segments and the second bore and moves the segments inward toward one another.

9. The sleeve of claim 7, wherein the segments comprise a material disposed therebetween and holding the segments outward from one another.

10. The sleeve of claim 9, wherein the material comprises interconnecting elements connected between adjacent segments.

11. The sleeve of claim 7, wherein the seat comprises at least one biasing element biasing the segments outward from one another.

12. The sleeve of claim 1, wherein the inner sleeve comprises a support disposed inside the second bore and supporting lower end portion of the compressible ring.

13. The sleeve of claim 1, wherein the upward extending portion of the compressible ring in an expanded condition is in contact with the landing ring in the first axial position.

14. The sleeve of claim 13, wherein the landing ring defines a ramp on one edge, the ramp engaging the upward extending portion of the compressible ring when the landing ring moves from the first axial position to the second axial position.

15. The sleeve of claim 1, further comprising an attachment disengageably holding the inner sleeve in the closed position.

16. The sleeve of claim 1, wherein at least one temporary fixture holds the landing ring in the first axial position and breaks with the application of the fluid pressure against the deployed plug seated in the landing ring.

17. A fluid treatment method for a wellbore, the method comprising:

deploying a plug downhole to a sliding sleeve;

engaging the plug against a landing ring disposed in a first axial position inside an inner sleeve of the sliding sleeve;

moving the inner sleeve open in the sliding sleeve by applying first fluid pressure against the plug engaged in the landing ring;

moving the landing ring in the inner sleeve to a second axial position by applying second fluid pressure against the plug engaged in the landing ring; and wedging a compressible ring against the engaged plug by contracting the compressible ring inward with the moved landing ring.

18. The method of claim 17, wherein wedging the compressible ring comprises fitting the landing ring in a space between an upward extending portion of the compressible ring and the inner sleeve; and wedging the upper extending portion of the compressible ring against the engaged plug by contracting the upward extending portion of the compressible ring inward, to a second contact dimension narrower than a first contact dimension of the landing ring, with the moved landing ring fitting in the space.

19. The method of claim 17, wherein applying the second fluid pressure comprises applying the second fluid pressure greater than the first fluid pressure.

20. The method of claim 17, wherein moving the inner sleeve open in the sliding sleeve by applying the first fluid pressure against the plug engaged in the landing ring comprises shearing the inner sleeve free from a closed condition in the sliding sleeve; and wherein moving the landing ring in the inner sleeve to the second axial position by applying the second fluid pressure against the plug engaged in the landing ring comprises shearing the landing ring free from the inner sleeve.

21. The method of claim 17, wherein the compressible ring comprises a plurality of segments disposed in the inner sleeve, each of the segments defining the space between the upward extending portion of the segment and the inner sleeve.

22. The method of claim 21, wherein fitting the landing ring in the space comprises fitting the landing ring in the second axial position in the space between the upward extending portions of the segments and the inner sleeve and moving the segments inward toward one another.

23. The method of claim 17, wherein contracting the upward extending portion of the compressible ring inward comprises engaging the upward extending portion of the compressible ring with a ramp on one edge of the landing ring when the landing ring moves from the first axial position to the second axial position.

* * * * *